US005415030A

United States Patent [19]

Jogi et al.

[11] Patent Number: 5,415,030

[45] Date of Patent: May 16, 1995

[54] METHOD FOR EVALUATING FORMATIONS AND BIT CONDITIONS

[75] Inventors: Pushkar N. Jogi; William A. Zoeller, both of Portland, Conn.

[73] Assignee: Baker Hughes Incorporated, Houston, Tex.

[21] Appl. No.: 225,423

[22] Filed: Apr. 8, 1994

Related U.S. Application Data

[63] Continuation of Ser. No. 819,378, Jan. 9, 1992, abandoned.

[51] Int. Cl.[6] ..... E21B 49/00

[52] U.S. Cl. ..... 73/151; 73/152; 175/39; 175/50

[58] Field of Search ..... 73/151, 151.5, 152; 175/39, 40, 50

[56] References Cited

U.S. PATENT DOCUMENTS

| | | | |
|---|---|---|---|
| 4,064,749 | 12/1977 | Pittman et al. | 73/152 |
| 4,627,276 | 12/1986 | Burgess et al. | 73/151 |
| 4,685,329 | 8/1987 | Burgess | 73/151 |
| 4,697,650 | 9/1987 | Fontenot | 73/151 |
| 4,833,914 | 5/1989 | Rasmus | 73/152 |
| 4,852,399 | 8/1989 | Falconer | 73/151.5 |
| 4,876,886 | 10/1989 | Bible et al. | 175/39 |
| 4,949,575 | 8/1990 | Rasmus | 73/152 |
| 4,981,036 | 1/1991 | Curry et al. | 73/151 |

FOREIGN PATENT DOCUMENTS

| | | |
|---|---|---|
| 0163426 | 4/1985 | European Pat. Off. . |
| 0351902 | 6/1989 | European Pat. Off. . |
| 0466255 | 3/1991 | European Pat. Off. . |
| 2350612 | 4/1974 | Germany . |

OTHER PUBLICATIONS

"Instantaneous Drilling Evaluation Log" European Drilling Symposium, Yogoslavia Jun. 1977 by William A. Zoeller.

The Drilling Porosity Log "DPL", SPE #3066, 45th annual meeting of SPE, Houston, Texas Oct. 5–8, 1970, by William A. Zoeller.

"Analysis of rock properties from drilling response", SPWLA Fifteenth Annual Logging Symposium, Jun. 2–5, 1976. by William A. Zoeller.

"Rock Properties determined from Drilling Response", Petroleum Engineer, Jul. 1974, by William A. Zoeller.

European Search Report.

*Primary Examiner*—Hezron E. Williams

*Assistant Examiner*—Michael J. Brock

*Attorney, Agent, or Firm*—Fishman, Dionne & Cantor

[57] ABSTRACT

A method for evaluating formations and bit conditions is presented. The present invention processes signals indicative of downhole weight on bit (WOB), downhole torque (TOR), rate of penetration (ROP) and bit rotations (RPM), while taking into account bit geometry to provide a plurality of well logs and to optimize the drilling process. Drilling operations are monitored and adjusted in response to these processed signals and logs. The processed signals may include the following signals: drilling response, differential pressure, pore pressure, porosity, porosity compensated for formation effects, drilling alert, bit wear factor, abnormal torque, and bearing wear. The logs may include a drilling response log, a differential pressure log, a porosity log, a porosity log compensated for formation effects, a drilling alert log, a wear factor log, a torque analysis log and a bearing wear log.

43 Claims, 10 Drawing Sheets

METHOD FOR EVALUATING FORMATIONS AND BIT CONDITIONS

This is a continuation of application Ser. No. 07/819,378, filed on Jan. 9,1992, now abandoned.

BACKGROUND OF THE INVENTION

This invention relates to a method for evaluating drilling conditions while drilling a borehole. More particularly, this invention relates to a method for evaluating formations and bit condition while drilling. Further, this invention relates to a method for providing drilling alerts when inefficient drilling conditions are identified.

A drill string generally has a lower portion which is comprised of relatively heavy lengths of uniform diameter drill collar. A drill bit is attached to the downhole end of the drill collar, where a portion of the weight of the collar is applied causing the bit to gouge and crush into the earth as the drill string is rotated from the surface (e.g., a rotary table with slips). Alternatively, a downhole motor is employed to rotate the bit. The downhole motor is generally employed in directional drilling applications.

Measurement-while-drilling (MWD) systems are known for identifying and evaluating rock formations and monitoring the trajectory of the borehole in real time. An MWD tool is generally located in the lower portion of the drill string near the bit. The tool is either housed in a section of drill collar or formed so as to be compatible with the drill collar. It is desirable to provide information of the formation as close to the drill bit as is feasible. Several methods for evaluating the formation using the drill bit have been employed. These methods eliminate the time lag between the time the bit penetrates the formation and the time the MWD tool senses that area of the formation. The measurements available are rate of penetration (ROP) and bit revolutions per minute (RPM) which are determined at the surface and, downhole weight on bit (WOB) and downhole torque on the bit (TOR) which are derived from real time insitu measurements made by an MWD tool. WOB and TOR may be measured by the MWD tools described in U.S. Pat. Nos. 4,821,563 and 4,958,517, both of which are assigned to the assignee hereof.

Methods employing ROP, RPM, WOB and TOR measurements have been developed to determine certain formation characteristics at the drill bit. One such method is disclosed in U.S. Pat. No. 4,883,914 to Rasmus. The Rasmus patent employs the aforementioned measurements (i.e., ROP, RPM, WOB, and TOR), a gamma ray measurement and a resistivity measurement to detect an overpressure porosity condition. The gamma ray and resistivity measurements are included in order to account for the volume of shale and the apparent resistivity in the formation. It is known that an overpressure condition occurs when water is trapped in a porous formation (i.e., overburden). This overburden condition prevents the shale in the formation from further compaction, whereby the compressive stress is transmitted to the interstitial water. Therefore, this portion of the formation will have a supernormal pressure when compared to that of the surrounding formation. The method of U.S. Pat. No. 4,883,914 employs this overpressure porosity to determine desired drilling mud pressure, pore pressure (i.e., formation pressure) and formation strength.

U.S. Pat. No. 4,852,399 to Falconer discloses a method for distinguishing between argillaceous, porous and tight formations by computing formation strength from ROP, RPM, WOB and bit diameter (D). The formations are distinguished by setting upper and lower shale limits.

European Patent No. EP 0351902A1 to Curry et al discloses a method for determining formation porosity from WOB and TOR measurements which factor in the geometry of the drill bit.

U.S. Pat. No. 4,697,650 to Fontenot discloses a method of compiling a history of ROP, RPM, WOB and TOR measurements. U.S. Pat. No. 4,685,329 to Burgess discloses a method of compiling a history of TOR/WOB and ROP/RPM based ratios in order to identify trends such as bit wear, pore pressure variation and changes in lithology.

U.S. Pat. No. 4,627,276 to Burgess et al discloses a method for determining wear of milled tooth bits from a bit efficiency term which is derived from ROP, RPM, WOB and TOR measurements and bit geometry.

SUMMARY OF THE INVENTION

The above discussed and other drawbacks and deficiencies of the prior art are overcome or alleviated by the method of the present invention for evaluating formations and bit condition while drilling. In accordance with the present invention, an MWD tool located near the bit of the drill string provides measurements of downhole weight on bit (WOB) and downhole torque (TOR). Additionally, rate of penetration (ROP) and bit revolutions (RPM) are measured and calculated at the surface. Provisions are made for drag and impact drill bits. These measurements and bit geometry data are processed by a processor to generate the following outputs: normalized torque (TOR/(WOB D)), rock drillability (ROP D/(WOB RPM)) and drilling response (TOR ROP/(WOB$^2$ RPM)). From these output signals a plurality of processed signals and logs are generated by a plotter. These logs aid in evaluating the formation and the bit.

For example, from a plot of normalized torque TOR/(WOB D) versus rock drillability ROP D/(WOB RPM), lithologies can be identified so that drilling operations can be adjusted accordingly. Further, drilling problems (e.g., bit balling, stabilizer caught on a borehole ledge, drill string sticking) can also be identified from this plot by noting any excursions away from the normal trend line. Such a plot can be generated at the processor and plotted by a plotter.

The above signals are further processed with the additional measurements of gamma ray and mud density (mud pressure is derived from mud density) the following signal outputs are provided: drilling response, porosity, porosity compensated for formation effects, differential pressure, pore pressure, drilling alert, bit wear factor (i.e., tooth/cutter wear), torque analysis (i.e., abnormal torque increase or loss) and bearing wear. Each of these signals may be employed to optimize the drilling process.

These signals are still further processed to provide the following logs: drilling response log, porosity log, porosity log compensated for formation effects, differential pressure log, drilling alert log, bit wear factor log, torque analysis log and bearing wear log. Each of these logs are generated by the graphical plotter.

The drilling response log can be used to identify formation changes, underbalance and overbalance drilling conditions, and other drilling problems at the bit while drilling. The porosity log provides an early indication of the porosity of the formation to reinforce/substitute other prior art porosity analyses, so that drilling conditions Call be modified accordingly for the formation. The porosity log compensated for formation effects provides a better indication of a possible commercial hydrocarbon formation. The differential pressure log provides an early indication of formation pressure so that drilling conditions can be optimized (e.g., adjust mud density). The drilling alert log can be used as an indicator of a potential drilling problem while drilling. The specific drilling problem or problems can be further evaluated by monitoring other logs commonly provided in drilling operations. The drilling alert log may indicate that drilling operations should cease and the drill string tripped or that drilling conditions be otherwise modified while drilling continues. The torque analysis log provides an early indication of such problems as undergage stablizers, formation squeeze, cutter wear (i.e., tooth wear) and sloughing shales. The bearing wear log only applies to impact bits and provides an early indication of bearing wear. The bit wear factor log represents the degree of cutter/tooth wear in a bit for both bit types. The drill string would be tripped and the bit changed in response to the excess bit/bearing wear indications by the corresponding log.

The above-discussed and other features and advantages of the present invention will be appreciated and understood by those skilled in the art from the following detailed description and drawings.

BRIEF DESCRIPTION OF THE DESCRIPTION

DESCRIPTION OF THE PREFERRED EMBODIMENT

Figure 1:
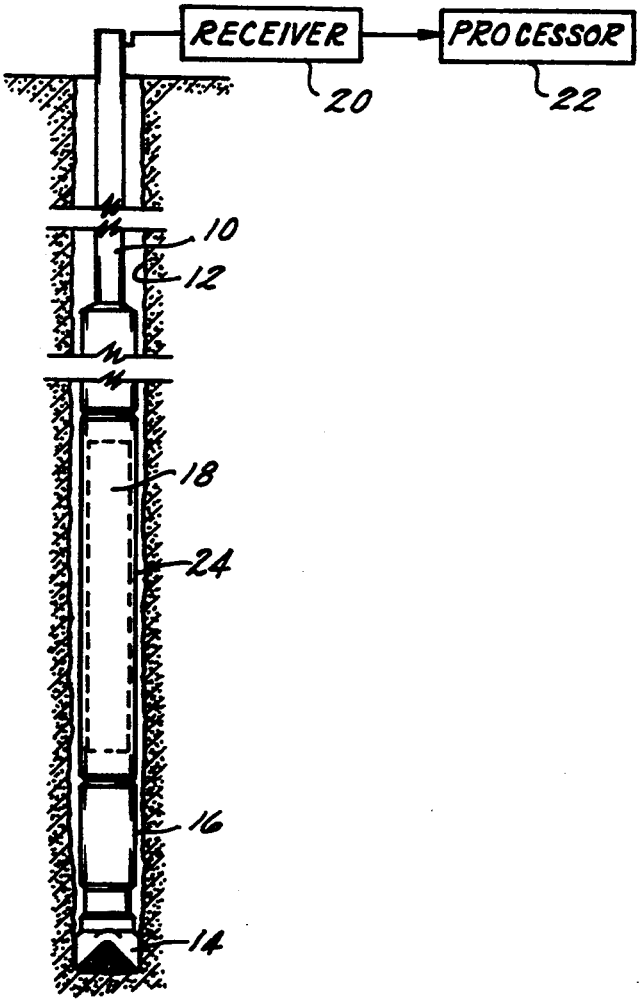
FIG. 1 is a combined side elevational view and block diagram depicting a drill string while drilling a borehole employing a MWD scheme in accordance with the present invention.

Referring initially to FIG. 1, there is shown a drill string 10 suspended in a borehole 12 and having a typical drill bit 14 attached to its lower end. Immediately above the bit 14 is a tool 16 for detection of downhole weight on bit (WOB) and downward torque (TOR). Tool 16 comprises a first MWD tool such as described in U.S. Pat. Nos. 4,821,563 and 4,958,517, both of which are assigned to the assignee hereof and incorporated herein by reference, to provide WOB and TOR measurements. Tool 16 also comprises a second MWD tool such as described in U.S. Pat. No. 4,716,973, which is assigned to the assignee hereof and incorporated herein by reference, to provide a gamma ray measurement. The output of tool 16 is fed to a transmitter 18 (e.g., a mud pulse telemetry system such as described in U.S. Pat. Nos. 3,982,431; 4,013,945 and 4,021,774, all of which are assigned to the assignee hereof and incorporated herein by reference). The transmitter 18 is located and attached within a special drill collar section and-[functions to provide (in the drilling fluid being circulated downwardly within the drill string 10) an acoustic signal that is modulated in accordance with sensed data. The signal is detected at the surface by a receiving system 20 and processed by a processing means 22 to provide recordable data representative of the downhole measurements. Although an acoustic data transmission system is mentioned herein, other types of telemetry systems may be employed, providing they are capable of transmitting an intelligible signal from downhole to the surface during the drilling operation.

The drill collar may also include a section 24 which carries other downhole sensors (e.g., neutron, gamma ray and formation resistivity). Each of these additional tools in section 24 may also be coupled to the telemetry apparatus of transmitter 18 in order that signals indicative of the measurer formation properties may be telemetered to the earth's surface.

Figure 2:
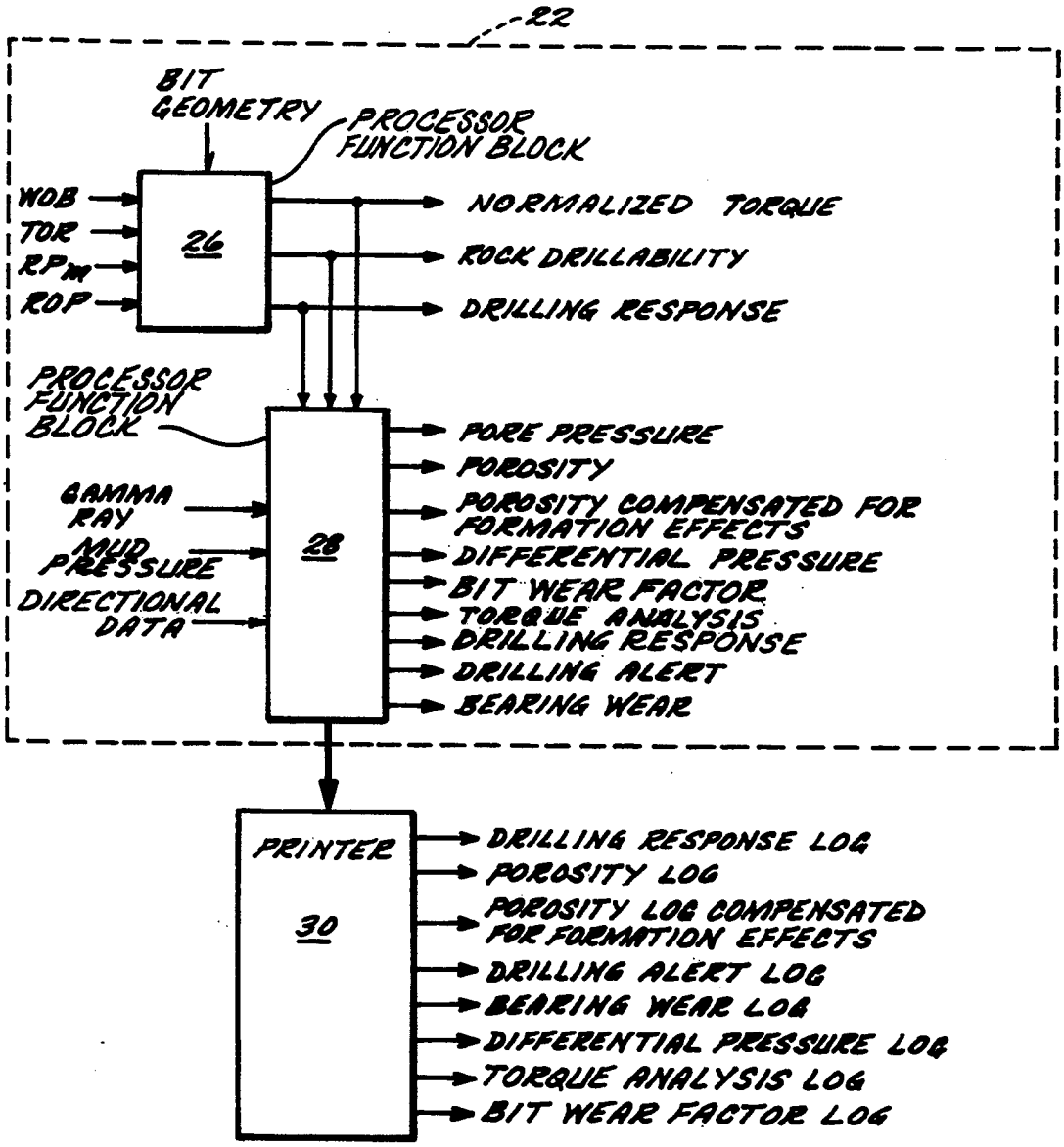
FIG. 2 is a block diagram of the processor shown in FIG. 1, illustrating the functions performed by the processor.

Reference is now made to FIG. 2 for a detailed representation of a preferred embodiment of the present invention. FIG. 2 illustrates the processing functions performed within the surface processing means 22. Processor 22 is a suitably programmed general, purpose digital computer. The functions performed by the software programming of processor 22 are generally indicated in functional block form at 26 and 28. Specifically, functional block 26 represents that portion of the software of processor 22 which receives as inputs WOB, TOR, RPM, ROP and bit geometry and generates the following outputs: normalized torque TOR/(WOB D), rock drillability ROP D/(WOB RPM) and drilling response TOR ROP/(WOB$^2$ RPM). Functional block 28 further processes the outputs of block 26 and includes inputs of mud density, gamma ray, directional data (e.g., true vertical depth, TVD) and generates the following output signals: drilling response, porosity, porosity compensated for formation effects, differential pressure, pore pressure, drilling alert, bit wear factor (i.e., tooth-/cutter wear), torque analysis (i.e., torque increase or torque loss) and bearing wear. Each of these signals may be employed to optimize the drilling process. These signals are still further processed to provide the following logs: drilling response log, porosity log, porosity log compensated for formation effects, differential pressure log, drilling alert log, bit wear factor log, torque analysis log and bearing wear log. Each of these logs are displayed by a plotter 30 and are used to monitor and correct drilling operations. The procedures of each of these blocks will be described in more detail below.

A method for evaluating formations and bit condition at the bit while drilling is presented. Provisions are made for drag and impact bits. Drag bits are generally polycrystalline diamond compact bits which have no moving parts and drill by a scraping motion. Impact bits include single or multi-cone bits which may include insert and milled tooth bits and which drill by a chipping and crushing motion and/or by a gouging and scraping motion.

The response of the bit to drilling at the formation (i.e., drilling response) is dependent upon cutter design (i.e., bit geometry). Cutter design factors include bit diameter, type of bit (i.e., impact or drag) and bit wear. Drilling response also depends on WOB and RPM. The more weight applied to the bit the greater the ROP. The higher the RPM, the greater the ROP. However, these factors are limited by how quickly the cuttings can be removed from the cutting surface of the bit (i.e., cleaning of the bit). If the cuttings are not removed, they will be regrinded. The type of formation (i.e., porous, shale or hardrock) also needs to be considered when determining drilling response.

The difference between mud pressure and pore pressure also affects the drilling response. When mud pressure is greater than pore pressure it is harder to drill the formation (e.g., chip hold-down theory). Accordingly, when pore pressure is greater than mud pressure it is easier to drill the formation. However, this may result in a blow out or borehole collapse. In practice and for safety considerations, it is desirable to maintain a slightly greater mud pressure relative to pore pressure to avoid these problems without a significant impact in drilling response.

General drilling models have been developed and are described below for the impact and drag bits. Initially, these models are based on the analysis of a single cutter. Thereafter, the models are integrated to provide a model for a complete bit. These models are to be stored in the memory portion of processor 22.

POLYCRYSTALLINE DIAMOND COMPACT (PDC) BIT MODEL

Figure 3:
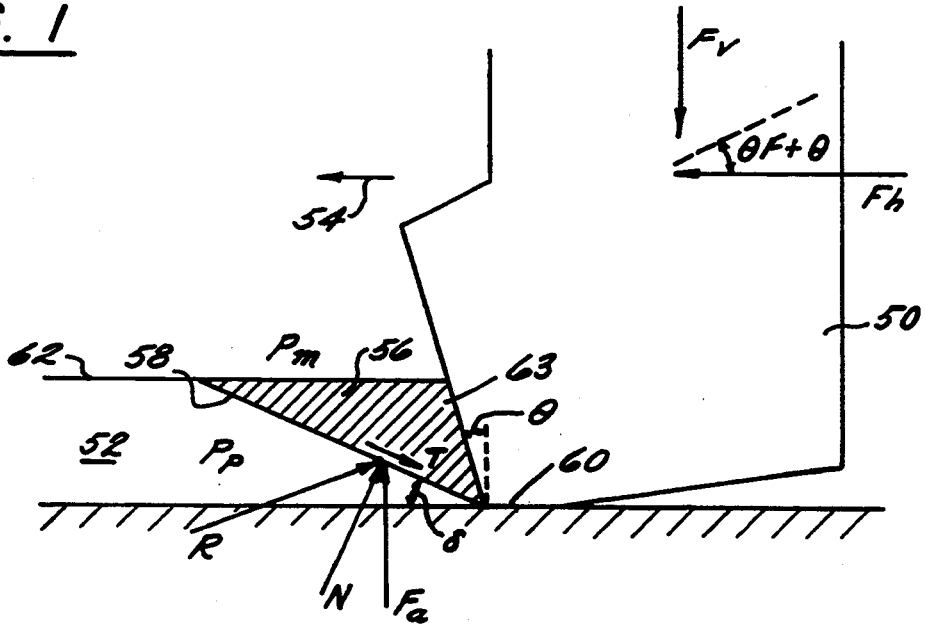
FIG. 3 is a side elevational view of the single tooth of a drag bit for use with the drill string of FIG. 1.

Referring now to FIG. 3, for purposes of modeling a PDC bit, a single cutter model is used. Hydraulic cleaning effects are not included in the model and it is assumed that the bit hydraulics are sufficient to remove all drilled particles and cuttings. A cutter 50 is shown moving relative to rock formation 52. The direction of movement is indicated by an arrow 54. It is assumed that a chip 56 is formed by the shearing process of cutter 50 against formation 52. The shearing process is confined to a single plane 58 (i.e., failure plane) extending from a cutting edge 60 to a surface 62. Chip 56 is held in equilibrium by a plurality of forces exerted by formation 52 and cutter 50.

Forces (Fv) and (Fh) represent the respective normal and horizontal components of the external forces acting on cutter 50. Angles ($\theta$) and ($\phi$) represent the back and side rake angles respectively. Angle ($\delta$) represents the angle of the failure surface 58. Along surface 58 the stresses are in equilibrium and are defined by the Mohr-Coulomb failure criteria. Drilling mud pressure (Pm) is assumed to act on the free surface 62.

The normal and horizontal external forces Fv and Fh acting on cutter 50 are defined by:

$$Fv=R\sin(\theta+\theta f) \quad 1$$

$$Fh=R\cos(\theta+\theta f)/\cos(\phi) \quad 2$$

where R is the resultant force acting on surface 58, and $\theta f$ is the angle of friction and is related to the coefficient of friction ($\mu f$) between the bit and the cutter by:

$$\mu f=\tan(\theta f) \quad 3$$

The area of cut (Ac) in formation 52 is defined by:

$$Ac=Ap\cos(\theta)\cos(\phi) \quad 4$$

where Ap is the area on cutting edge 63 corresponding to the area of cut Ac.

The resultant force Fa on surface 58 due to the effective mud pressure Pm is defined by:

$$Fa=Pm(Ap\cos(\theta+\delta)/\sin(\delta)) \quad 5$$

The normal force (N) and shear force (T) on surface 58 are defined by:

$$N=R\sin(\theta+\theta f+\delta)+Fa\sin(\delta) \quad 6$$

$$T=R\cos(\theta+\theta f+\delta)-Fa\sin(\delta) \quad 7$$

Figure 4:
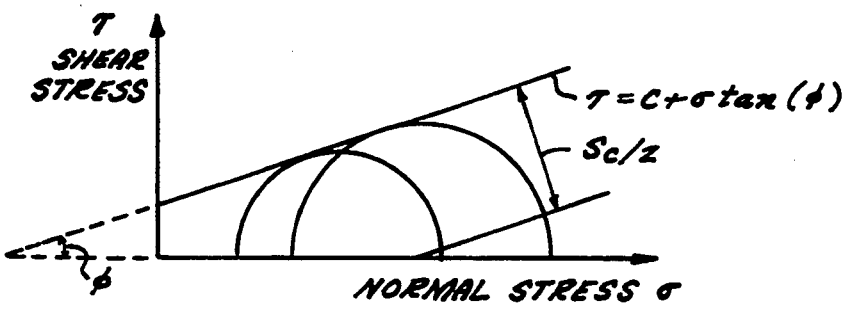
FIG. 4 is a plot of the Coulomb-Mohr failure envelope.

Rock formation 52 fails when shear stress exceeds a critical threshold value. The Mohr-Coulomb failure criteria is shown in FIG. 4 and is defined as follows:

$$c=\tau_f-\mu(\sigma_f-Pp) \quad 8$$

where Pp is the pore pressure.

The average shear stress ($\tau_f$) and the average normal stress ($\sigma_f$) are defined by:

$$\tau_f=(R\cos(\theta+\theta f+\delta)-Pm\sin(\delta))\sin(\delta)\cos(\phi)/Ac \quad 9$$

$$\sigma_f=(R\sin(\theta+\theta f+\delta)+Pm\cos(\delta))\sin(\delta)\cos(\phi)/Ac \quad 10$$

The coefficient of internal friction ($\mu$) is defined by:

$$\mu=\tan(\phi) \quad 11$$

where $\phi$ is the angle of internal friction, FIG. 2. The cohesive strength (c) is defined by:

$$c=Sc(1-\sin(\phi)/(2\cos(\phi)) \quad 12$$

where Sc is the rock compressive strength.

Substituting Eqs. 9 and 10 into Eq. 8 gives:

$$(R/Ap)\sin(\delta)\cos(\theta+\theta f+\phi+\delta)-Pm\cos(\theta\phi)\sin(\theta+\phi)=(c-Pp\tan(\phi))\cos(\theta)\cos(\phi) \quad 12a$$

Failure will occur when the maximum value of the shear stress equals the cohesive strength c. The maximum value of ($\tau$f-($\sigma$f-Pp) tan ($\phi$)) occurs on a plane inclined at failure angle $\delta$. Using the resulting equation and Eq. 12a, the resultant force R at surface 58 can be expressed as:

$$R=Ap2c(\cos(\theta)\cos(\phi))/[(1-\sin(\theta+\theta f+\phi))f(Pp,Pm)] \quad 13$$

where the differential pressure factor f(Pp, Pm) is given by:

$$f(Pp,Pm)=1/(1+(Pm-Pp)\alpha) \text{ and,}$$

$$\alpha=(\cos(\theta f)+\sin(\phi-\theta))/(2c\cos(\theta)\cos(\phi))$$

If rock drilling strength is defined as:

$$\sigma=(Fv\cos(\phi))/(Ac\tan(\theta)) \quad 14$$

then by solving Eqs. 4, 12 and 13 for Ac and substituting Ac and Fv (Eq. 1) into Eq. 14 the normal stress $\sigma$ is expressed as:

$$\tau=Sc(1-\sin(\phi))\sin(\theta+\theta f)/(f(Pp,Pm)\tan(\theta)(1-\sin(\theta+\theta f+\phi))) \quad 15$$

Rock shear strength can be defined as:

$$\tau=(clFh\cos(\phi))/Ac \quad 16$$

assuming that the shear force Fh is proportional to the area of cut Ac and where cl is a constant. Then by solving Eqs. 4, 12 and 13 for Ac and substituting Ac and Fh (Eq. 2) into Eq. 16, the shear stress $\tau$ is expressed as:

$$\tau=cl\,Sc(1-\sin(\phi))\cos(\theta+\theta f)/(f(Pp,Pm)(1-\sin(\theta+\theta f+\phi))) \quad 17$$

It will be appreciated that both normal stress $\sigma$ and shear stress $\tau$ are a function of $\delta P$ which is the difference between the mud pressure Pm and the pore pressure Pp. $\delta P$ is referred to herein as differential pressure and is an important feature of the present invention.

The effect of cutter wear can be included in Eqs. 14 and 16 as follows:

$$Fv=\sigma((Ac/\cos(\phi)\tan(\theta))+Aw) \quad 18$$

where Aw is the area of the wear surface on cutter 60, and $$Fh=\tau((Ac/(\cos(\phi)\,cl))+\mu_e(\sigma/\tau)Aw) \quad 19$$

where $\mu_e$ is the effective coefficient of friction caused by the cutting angle. Eliminating Aw from Eqs. 18 and 19 results in the following equation:

$$Fh=\mu_e Fv\cos(\phi)+Ac(\tau/cl)(1-\mu_e(\sigma/\tau)(\tan(\theta)cl) \quad 20$$

The model for a single cutter is now expanded to provide a model for a complete bit. It is assumed that all cutters on the bit can be arranged such that they form a single cutter of radius D/2 where D is the bit diameter. The force dFv acting on a small element of cutter 50 of a length dr is given by:

$$dFv=(2WOB/D)dr \quad 21$$

The force dFh required to gouge cutter 50 through formation 52 is derived from Eq. 20 as follows:

$$dFh=\mu_e dFv\cos(\phi)+dAc(\tau/cl)(1-\mu_e(\sigma/\tau)(\tan(\theta)cl)) \quad 22$$

the torque dTOR required to gouge cutter 50 through formation 52 is given by:

$$dTOR=dFh\,r \quad 23$$

Substituting dFh (Eq. 22) into Eq. 23 then integrating Eq. 23 results in the following expression for torque on the bit (TOR):

$$TOR=\mu_e\cos(\phi)WOBD/4+(\tau/cl)(1-\mu_e(\sigma/\tau)(\tan(\theta)cl)\int_o^{D/2}r\,dAc \quad 24$$

A volume (dV) of rock 52 cut by cutter 50 of length (dr) at a radius (r) from the center of the bit in one revolution of the bit is expressed as:

$$dV=2\pi r dAc \quad 25$$

The volume (V) of rock removed by the bit in one revolution can be expressed as:

$$V=(\pi D^2/4)ROP/RPM \quad 26$$

Eqs. 24–26 can be solved to result in the following expression for normalized torque TOR/(WOB D):

$$TOR/(WOB\,D)=(\mu_e/4)\cos(\phi)+(\tau/8\,cl)(1-\mu_e(\sigma/\tau))(\tan(\theta)\,cl)(ROP\,D/(WOB\,RPM)) \quad \text{Eq. 27}$$

where (ROP D/(WOB RPM)) is referred to herein as rock drillability. Eq. 27 can be expressed as:

$$TOR/(WOB\,D)=S_1+S_2(ROPD/(WOBRPM)) \quad 28$$

where:

$$S_1=(\mu_e/4)\cos(\phi)$$

$$S_2=(\tau/8cl)(1-\mu_e(\sigma/\sigma))(\tan(\theta)cl)$$

The normalized torque signal and the rock drillability signal for a drag bit are defined by the above described relationship.

Eq. 18 can also be expressed as:

$$Fv=(\sigma/\eta)Ac\sin(\theta)/\cos(\phi) \quad 29$$

where the wear factor n is an indicator of bit/cutter condition and can be expressed as:

$$\eta=1/(1+Aw\cos(\phi)/(Ac\tan(\theta))) \quad 30$$

where n varies from 1 (for a new bit) to 0 (for a completely worn bit).

The term (WOB RPM/(ROP D)) which is the inverse of rock drillability ROP D/(WOB RPM) is related to rock strength $\sigma$ and wear factor $\eta$ by:

$$WOB\,RPM/(ROP\,D)=((\sigma/2)\tan(\theta)/\cos(\phi)\eta \quad 31$$

Normalized torque TOR/(WOB D) is expressed below incorporating the wear factor term $\eta$ as:

$$TOR/(WOB\,D)=(\tau/\sigma)(\cos(\phi)/4cl\tan(\theta))f(\eta) \quad 32$$

where:

$$f(\eta)=\eta+\mu_e(1-\eta)(\sigma/\tau)cl\tan(\theta)$$

Drilling response is defined as (TOR ROP/(WOB$^2$ RPM)) and is given by:

$$TOR\,ROP/(WOB^2\,RPM)=(\tau/\sigma^2)(\cos^2(\phi)/(2cl\tan^2(\theta)))\,\eta f(\eta) \quad 33$$

wherein:

$$TOR\ ROP/(WOB^2\ RPM)=(\tau/\sigma^2)(\cos(\phi)/2cl\ \tan^2(\theta)));$$

for a new bit (where $\eta=1$) and, $$TOR\ ROP/(WOB^2\ RPM)=0;$$

for a completely worn bit (where $\eta=0$). An expression for a drilling response log is defined by:

$$\log(TOR\ ROP)/(WOB^2\ RPM)) = \log(\tau/\sigma^2) + \log((1/(2\ cl\ \tan^2(\theta))) + \log(\eta(f(\eta))) + \log C \quad \text{Eq. 34}$$

where:

$$C=\cos^2(\phi)/(\tan^2(\theta)2cl);$$

$\log(\tau/\sigma^2)$ is referred to herein as the formation response; and $\log(\cos^2(\phi)/(\tan^2(\theta)\ 2cl))$ is a bit related constant and the term $\log(\eta(f(\eta)))$, is related to formation compaction/bit wear. Therefore, the drilling response log represents a formation response curve superimposed on a formation compaction curve. The drilling response signal and the drilling response log are defined by the above described relationships. It will be noted that the effect of bit/cutter on the drilling response is compensated for by introducing a shale base line (to be described hereinafter).

IMPACT BIT MODEL

The model for impact bits is based on the penetration of a wedge into rock formation and is divided into two parts: (1) where the formations is drilled by the crushing or chipping action of the bit (e.g. for medium to hard formations), and (2) where the formation is drilled by the gouging action of the teeth (e.g., for soft formations). The model is combined for the case where both crushing and gouging are present. In the derivation of the model hydraulic cleaning effects are not included and it is assumed that the bit hydraulics are sufficient to remove all drilled particles and cuttings.

Figure 5:
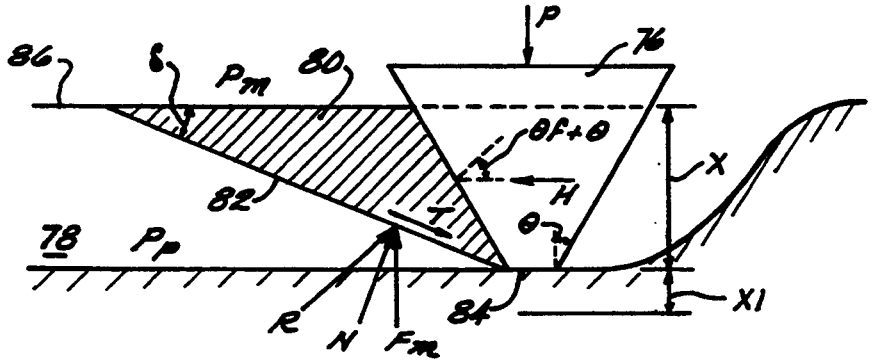
FIG. 5 is a side elevational view of a single tooth of an impact bit for use with the drill string of FIG. 1.

Referring to FIG. 5 wherein terms common to the drag bit (PDC) model are also used for the impact bit model. For purpose of modeling an impact bit a single cutter model is used. A cutter 76 is shown moving relative to rock formation 78. During the chipping process when a depth of penetration is reached stresses develop which are sufficient to cause the rock formation to fail. The cutter 76 chips a region of formation 78 when a depth (x) is reached, a chip 80 is formed having a failure plane 82. It is assumed that the failure plane 82 extends from a flat portion 84 of cutter 76 to a surface 86.

Force (P) represents the external force acting on the cutter 76. An angle ($\theta$) represents half the wedge angle, an angle ($\delta$) represents the angle of the failure surface 82 and L represents the wedge length. Cutter or tooth 76 penetrates formation 78 at depth x. Along the failure surface 82 the stresses are in equilibrium and are defined by the Mohr-Coulomb failure criteria.

Drilling mud pressure (Pm) is assumed to act on surface 80. The external force P acting on cutter 76 is related to the resultant force R acting at the surface 86 and is given by:

$$P=2R\sin(\theta+\theta f) \quad 35$$

where $\theta f$ is the angle of friction.

The force Fm on surface 82 due to the effective mud pressure Pm is defined by:

$$Fm=L\ x(\tan(\theta)+\cos(\delta))Pm \quad 36$$

The normal force (N) and shear force (T) on surface 82 are expressed as:

$$N=R\sin(\theta+\theta f+\delta)+Fm\cos(\delta) \quad 37$$

$$T=R\cos(\theta+\theta f+\delta)-Fm\sin(\delta) \quad 38$$

where the angle of friction $\theta f$ is related to coefficient of friction $\mu f$ between the rock and[tooth by $\mu f=\tan(\theta f)$. The average shear stress ($\tau_f$) and the average normal stress ($\sigma_f$) along surface 82 are defined by:

$$\sigma_f=(\sin(\delta)/x\ L)(R\sin(\theta+\theta f\phi)+Fm\cos(\delta) \quad 39$$

$$\tau_f=(\sin(\delta)/x\ L)(R\cos(\theta+\theta f\phi)-Fm\sin(\delta) \quad 40$$

The Mohr-Coulomb criteria :states that failure occurs when shearing stress $\tau_f$ exceeds the sum of cohesive strength c and frictional resistance to slip along the failure plane and is expressed by:

$$\tau_f-\sigma_f\tan(\phi)=c-Pp\tan(\phi) \quad 41$$

where $\phi$ is the angle of internal friction. Thus, failure will occur when the maximum value of shear stresses equal the cohesive strength c, the maximum value occurring at the failure angle $\delta$. The effective cohesive strength c is defined by:

$$c=(Sc/2\ (1-\sin(\phi))/\cos(\phi) \quad 42$$

where Sc is the rock compressive strength. Eqs. 39–42 can be solved to provide the following expression for the resultant force R:

$$(R/x\ L)=(2c\cos(\theta)\cos(\phi)/(f(Pp,\ Pm)\ (1-\sin(\theta+\theta f+\phi))) \quad 43$$

where:

$$f(Pp,Pm)=1/(1+(Pp,Pm)\gamma);$$

and $$\gamma=(\cos(\theta f)+\sin(\phi-\theta))/(2c\cos(\theta)\cos(\phi)) \quad 44$$

The same result can be obtained when the gouging action of the tooth is also present. In that case:

$$P=R\sin(\theta+\theta f) \quad 45$$

$$H=R\cos(\theta+\theta f) \quad 46$$

where P is the force required to maintain the depth of penetration and H is the gouging force. The effective area (As) under the cutter with crushing only is expressed as:

$$Ae=2xL\tan(\theta) \quad 47$$

The effective area Ae (Eq. 47) including the affects of gouging and crushing is expressed as:

$$Ae=xL\tan(\theta) \quad 48$$

If rock drilling strength is defined as:

$$\sigma = P/Lx \tan(\theta)$$

and rock shear strength is defined as $\tau = H/Cl\ L\ x$ where $C_1$ is a constant of proportionality. In either case normal stress $\sigma$ and shear stress $\tau$ can be expressed as:

$$\sigma = Sc\,(1-\sin(\phi))\sin(\theta+\theta f)/f(Pp, Pm)\tan(\theta)\,(1-\sin(\theta+\theta f+\phi) \quad 49$$

$$\tau = cl\,Sc(1-\sin(\phi))\cos(\theta+\theta f)/(f(Pp, Pm)\,(1-\sin(\theta+\theta f+\phi))) \quad 50$$

The effect of cutter wear on force P can be included as follows:

$$P = \sigma((Lx\tan(\theta))+Aw) \quad 51$$

and, the effect of cutter wear on force H can be factored in as follows:

$$H = \tau((Lx/cl)+\mu(\sigma/\tau)\,Aw) \quad 52$$

where $Aw = 2L\ x1 \tan(\theta)$.

If it is assumed that all cones of the tricone bit act as one composite cone then all teeth in contact on the three cones can be treated as a continuous set of teeth having a length approximately equal to the bit radius on one row of the composite cone. Thus, $P = 2c2\ W\ L/D$ where c2 is a constant for the bit. Also as the bit rotates, each tooth under the influence of applied weight crushes the rock first and then scrapes it. Since crushing and scraping follow each other almost simultaneously, the resultant weight applied to the formation is through the flat 84 (FIG. 5) and one side of the tooth. The scraping action is caused by the cone offset. In general, particularly for softer formations, a greater percentage of rock removed per revolution (and consequently the amount of work done in removing the rock), is believed to be due to the gouging action of the teeth. For purposes of modeling it may be assumed that total work (Wt) done by the bit in one revolution during crushing and gouging is divided as follows:

$$Wt = \alpha 1\ Wg + (1-\alpha 1)Wc \quad 53$$

where $\alpha 1$ is a factor dependent on rock and bit, Wg is the work done by gouging, and Wc is the work done by crushing. The work done per revolution during gouging $Wg_0$ can be expressed as:

$$Wg_0 = \alpha 1(H/L)\,(\pi D^2/4) \quad 54$$

The work done per revolution in crushing $Wc_r$ can be expressed as:

$$Wc_r = (1-\alpha 1)\int_{x1}^{x+x1} P\,Ni\,dy \quad \text{Eq. 55}$$

where:

$P = \sigma L\ y \tan(\theta)$; and $N_i$ is the number of tooth impacts per revolution;

x1 is the wear depth as is shown in FIG. 5;

x is the penetration depth as is shown in FIG. 5.

Further, it is assumed that the total volume (Vt) of rock removed is contributed in a similar manner by both gouging and crushing action and is expressed as:

$$Vt = \alpha 1\ Vg + (1-\alpha 1)Vc \quad 56$$

where Vg is the volume of rock removed by gouging, and Vc is the volume of rock removed by crushing. The volume of rock removed during gouging $Vg_0$ can be expressed as:

$$Vg_0 = \alpha 1(\pi D^2/4)x \quad 57$$

The volume of rock removed during crushing/chipping $Vc_r$ can be expressed as:

$$Vc_r = (1-\alpha 1)\int_{x1}^{x+x1} Ni\,L\,Cr\tan(\theta)\,y\,dy \quad \text{Eq. 58}$$

where:

$Cr = \tan(\delta)/\tan(\theta)$

When crushing without chipping $Cr = 1$ and $(\theta+\delta) < 90°$. The cones and cutters on a bit are designed such that each tooth contacts the formation only once per revolution. The total number of indentations per revolution Ni is given by:

$$Ni = Nt\ \mathrm{cosec}\,(\theta c/2) \quad 59$$

where $\theta c$ is the cone angle and Nt is the total number of teeth on the three cones.

The total work done (W) per revolution is given by:

$$W = 2\pi\ TOR = \alpha 1\,(H/L)\,(\pi D^2/4) + (1-\alpha 1)\int_{x1}^{x+x1} P\,Ni\,dy \quad \text{Eq. 60}$$

The total volume of rock removed (V) per revolution is given by:

$$V = (\pi/4D^2)\,(R/N) = \alpha 1\,(\pi/4D^2)\,x + (1-\alpha_1)\int_{x1}^{x+x1} Ni\,L\,Cr\tan(\theta)\,y\,dy \quad \text{Eq. 61}$$

Eq. 51 can also be expressed as:

$$P = \sigma L\tan(\sigma)x/\eta \quad 62$$

where $\eta$ is the wear factor which is an indicator of bit condition. It can be expressed as:

$$\eta = 1/(1+2x1/x) \quad 63$$

where $\eta$ varies from 1 (for a new bit) to 0 (for a completely worn bit).

Using Eqs. 60, 62 and 52 the following expression for torque TOR is obtained:

$$TOR = \alpha 1\,(D^2/8)\,(\tau/c1)\times(1+\mu\,c1\,(\sigma/\tau)\tan(\theta)\,(1-\eta)/\eta) + (1-\alpha 1)\,Ni\,\sigma\,L\tan(\theta)\,x^2/(2\pi\eta) \quad \text{Eq. 64}$$

From equations 61, 62 and 64, the following relation between normalized torque TOR/(WOB D) and rock drillability ROP D/(WOB RPM) can be obtained:

$$TOR/(WOB\ D) = S_1 + S_2\,(ROP\ D/(WOB\ RPM)) \quad 65$$

where:

$$S_1=(\alpha 1c2/4)\ (\eta((\tau/\sigma)\ (1/cl\ \tan\ (\theta)))-\tan\ (\theta)/\tan\ (\delta))+\mu(1-\eta))$$

$$S_2=(\sigma\ \tan\ (\delta))/(8\ \tan\ (\theta))$$

The normalized torque signal and the rock drillability signal for an impact bit are defined by the above described relationship.

The slope $S_2$ is a constant and is function rock properties only. The intercept $S_1$ which is a function of $\alpha 1$ and $\eta$ is representive of the contribution from gouging which changes with bit wear. Depending upon the sign of $((\tau/\sigma)\ (1/\text{cl}\ \tan\ (\theta))-(\tan\ (\theta)/\tan\ (\delta))$ the intercept $S_1$ on the normalized torque TOR/(WOB D) versus rock drillability ROP D/(WOB RPM) plot (FIG. 6) can be positive or negative. However, data indicates that the intercept is positive, thereby implying that $(\tau/\sigma)\ (1/\text{cl}\ \tan\ (\theta))\geqq(\tan\ (\theta)/\tan\ (\delta))$ Normalized torque TOR/(WOB D) and rock drillability ROP D/(WOB RPM) can be expressed as:

$$TOR/(WOB\ D)=(TOR/(WOB\ D))_0 f(\eta) \quad 66$$

and $$ROP\ D/(WOB\ RPM)=(ROP\ D/(WOB\ RPM))_0\eta \quad 67$$

where:

$$f(\eta)\ (\eta=(1-\eta)\ (c2\ \mu/4)/(TOR/(WOB\ D))_0); \quad 68$$

$$(TOR/(WOB\ D))_0=(\tau/\sigma)\ c2/(4cl\ \tan\ (\theta))\ f1; \quad 69$$

$$f1=\alpha 1+(1-\alpha 1)B_i(WOB/\sigma D^2)\ (4c1/c2)\ (\sigma/\tau)\ \tan\ (\theta); \quad 70$$

$$(ROP\ D/(WOB\ RPM))_0=c2\ (2/\alpha\ \tan\ (\theta))f2;\ \text{and} \quad 71$$

$$f2=\alpha 1+(1-\alpha 1)B_i(WOB/\sigma D^2)\ \tan\ (\delta). \quad 72$$

where $B_i=(2\ c2\ \text{Ni}\ L)/(\pi D^2\ \tan\ (\theta))$; is a bit dependent constant.

A drilling response term (TOR ROP/(WOB$^2$ RPM)) is defined as:

$$TOR\ ROP/(WOB^2\ RPM)=(\alpha 1^2 c2^2/(2cl\ \tan^2(\theta))\ (\tau/\sigma)\ (f1)\ (f2)\ (\eta f(\eta)) \quad 73$$

wherein:

TOR ROP/(WOB$^2$ RPM)=(TOR ROP/(WOB$^2$ RPM))$_0$; for a new bit ($\eta=1$), and TOR ROP/(WOB$^2$ RPM)=0; for a completely worn bit ($\eta=0$). A drilling response log is defined by:

$$\log\ (TOR\ ROP/(WOB^2\ RPM)) = \log(CC) + \log(\tau/\sigma^2) + \log(f1) + \log(f2) + \log\ (\eta\ f(\eta)) \quad \text{Eq. 74}$$

where log (CC) is a bit dependent term, log $(\tau/\sigma)$ is the formation dependent term, log $(\eta f(\eta))$ is the wear/compaction dependent term and log (f1) and log (f2) are generally small. The drilling response signal and the drilling response log are defined by the above described relationships.

Figure 6:
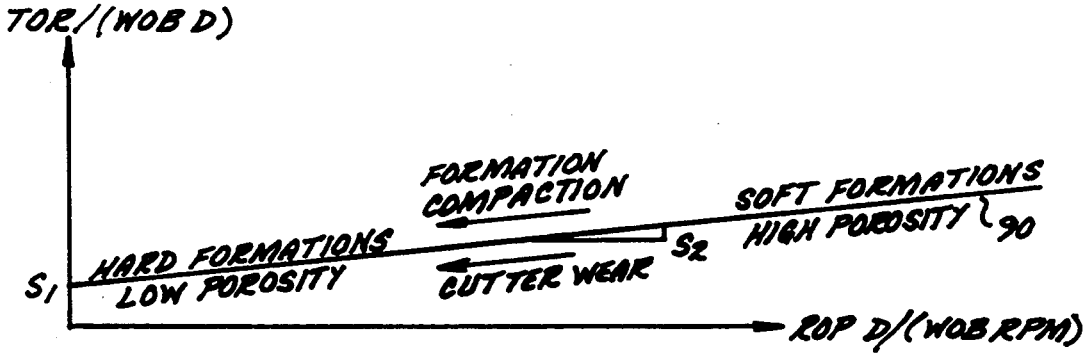
FIG. 6 is a plot of normalized torque versus rock drillability for the drill string of FIG. 1.

Referring to FIG. 6 a plot of normalized torque TOR/(WOB D) versus rock drillability ROP D/(WOB RPM) is shown. The intercept ($S_1$) for ROP=0 is a function of the wear factor $\eta$ and the coefficient $\mu$, which may vary for different formations. The slope ($S_2$) of the plot is a function of rock stresses $(\tau,\sigma)$. The plot indicates that both normalized torque TOR/(WOB D) and rock drillability ROP D/(WOB RPM) increase for high porosity/soft formations and decrease for low porosity/hard formations.

This plot provides formation evaluation at the bit in real time with only a mechanical response and may be provided by plotter 30 along with other drilling data. Lithologies can be determined by locating the normalized torque TOR/(WOB D) versus rock drillability ROP D/(WOB RPM) ratio on a line 90. The plot at the left indicates a low porosity formation and at the right indicates a high porosity formation. It will be appreciated that as the cutters wear or the compaction of the formation increases the formation will appear to be harder to drill, thus the data points merge closer to the origin. A number of drilling problems will also cause the formation to appear harder to drill. Bit balling or imperfect cleaning are indicated by both ROP and TOR decreasing and WOB/TOR increasing. A drill string stabilizer caught on a ledge (below the MWD tool) will cause ROP and normalized torque TOR/(WOB D) to decrease while WOB is increasing. Further, the drill string sticking at a bend is indicated by WOB, TOR, ROP and normalized torque TOR/(WOB D) decreasing. Similarly an undergage bit is indicated by ROP decreasing and TOR increasing. The above list is offered for purpose of illustration and is not intended to be a complete list of possible drilling problems.

Figure 7:
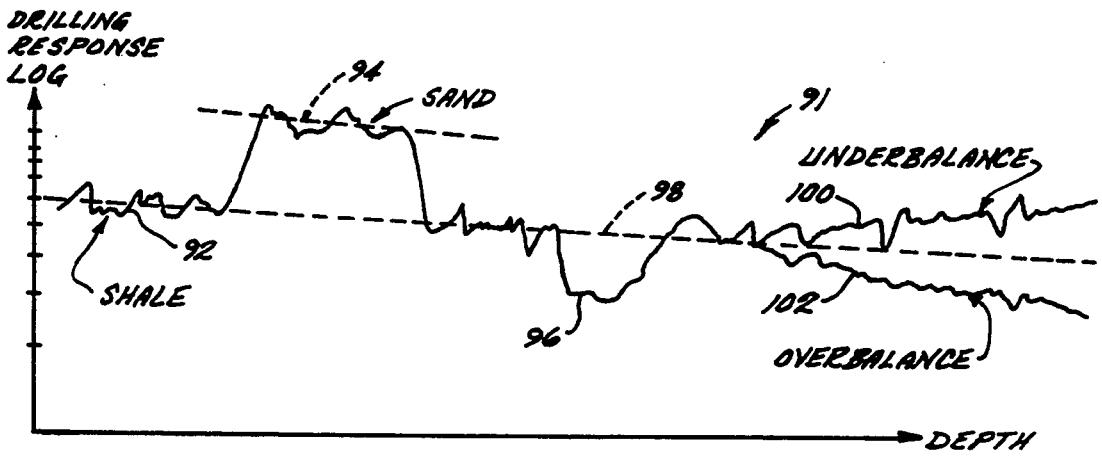
FIG. 7 is a drilling response log in accordance with the present invention.

Referring now to FIG. 7, an example of a drilling response log produced by plotter 30 in accordance with the present invention is shown generally at 91. This log 91 represents formation response at the bit in real time, thus identifying lithology changes and detecting problems at the bit prior to indication by standard MWD tools (located above the bit). From log 91 it can be seen that shale formations can be identified at 92 and sand formations can be identified at 94. Further, low porosity or hard to drill formations can be identified at 96. For a constant WOB and RPM a high ROP and TOR indicates a porous formation (i.e., formation identified at and a low ROP and TOR indicates a hard to drill formation (i.e., formation identified at 96). A normal trend line 98 (i.e., the shale base line to be described hereinafter) represents normal shale compaction. Line 98 is to be initially oriented with log 91 to establish a reference for evaluating log 91. Excursions above line 98 indicate porous/low density/low strength formations. Excursion below line 98 represent hard/low porosity formations. However, excursions below line 98 could also indicate other drilling problems. Slope changes in log 91 represent underbalance (i.e., Pp>Pm) and overbalance (i.e., Pp<Pm) conditions and are identified at 100 and 102 respectively. It will be appreciated that there is less resistance to drilling above the normal trend line 98 than below the normal trend line 98. Therefore, excursions above line 98 could be associated with easier/efficient drilling and excursions below line 98 could be associated with less efficient drilling. Inefficient drilling can be caused by any of the aforementioned drilling problems and/or other drilling problems.

FORMATION DRILLING POROSITY

Porosity can now be determined wherein all porosities are converted to an equivalent porosity (e.g., sand) for purposes of modeling. The drilling log can be expressed by:

$$\log(TOR\ ROP)/(WOB^2\ RPM)) = \log(TOR/(WOB\ D))_o - \log(WOB\ RPM/(ROP\ D))_o + \log(\eta\ F(\eta)) \quad \text{Eq. 75}$$

Figure 8:
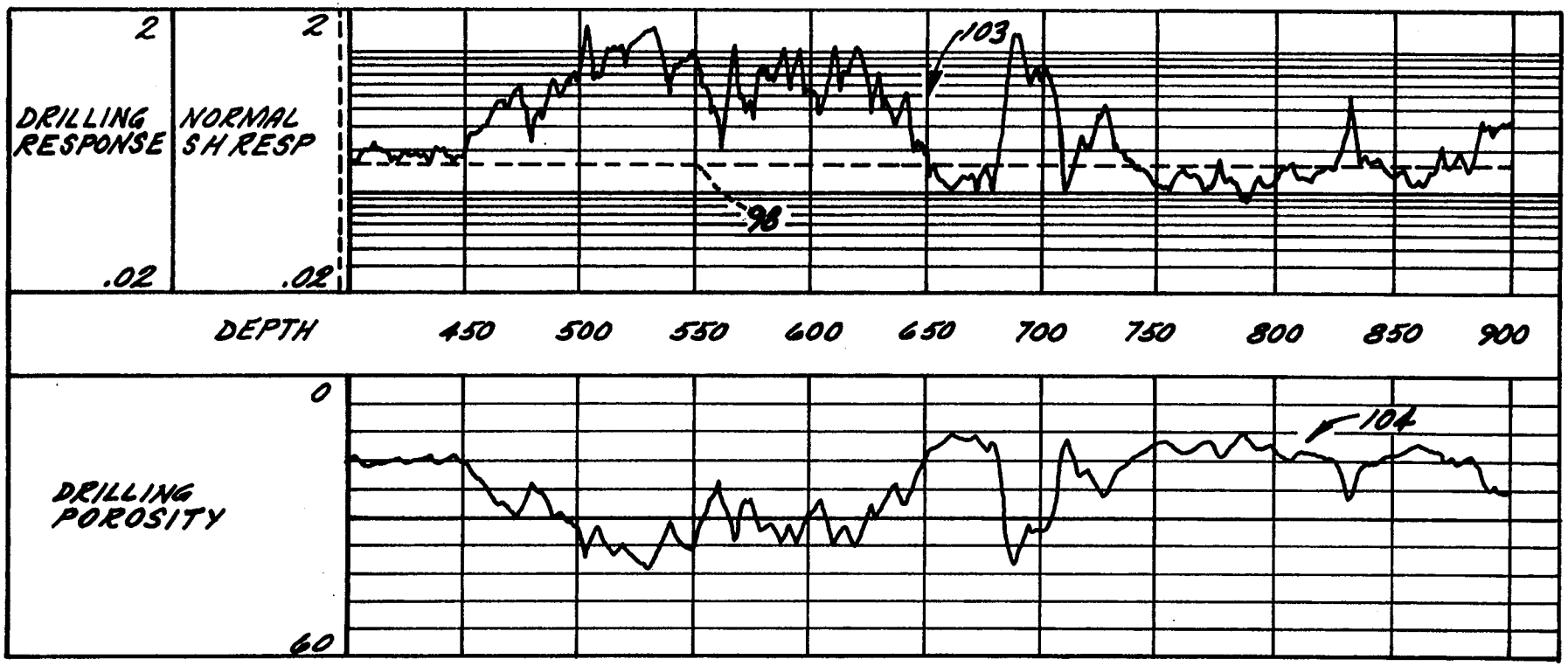
FIG. 8 is a porosity log in accordance with the present invention.

If it is assumed that a new bit is used (i.e., $\eta=1$), normal pressure conditions exist (i.e.,. Pm−Pp=0) and only one lithology with varying porosity is being evaluated, then $(WOB\ RPM/(ROP\ D))_0$ and $(TOR/(WOB\ D))_0$ depend only on formation porosity and Eq. 75 can be expressed as:

$$\log(TOR\ ROP/(WOB^2\ RPM)) = \log(TOR/(WOB\ D))_M\ \Phi_0^{1/N} - \log(WOB\ RPM/(ROP\ D))_M\ (1-\Phi_0^{1/N}) \quad \text{Eq. 76}$$

where N is an integer, $(TOR/(WOB\ D))_M$ and $(WOB\ RPM/(ROP\ D))_M$ are matrix constants, and $\Phi_0$ is porosity. Solving Eq. 76 for $\Phi_0$ and letting N=2 (the quadratic form was found to best fit field results) provides the following expression for porosity $\Phi_0$:

$$\Phi_0 = A1\ (\log(TOR\ ROP/(WOB^2\ RPM)))^2 + A2\ (\log(TOR\ ROP/(WOB^2\ RPM))) + A3 \quad 77$$

where A1, A2 and A3 are constants which may be determined empirically or from data. The porosity signal and the porosity log are defined by the above described relationship. Referring to FIG. 8, an example of a porosity log produced by plotter 30 in accordance with the present invention is shown generally at 104. Log 104 is shown in relation to drilling response log 103. This log 104 represents formation porosity, thus identifying lithology changes and detecting drillings problems.

Since Eq. 77 is good for only one lithology, to evaluate porosity for a sand-shale sequence the formation must be reduced to one lithology (e.g. sand porosity). The porosity of shale $\Phi_{sh}$ at any depth is defined by:

$$\Phi_{sh} = \Phi_{max} e^{-(C3\ TVD)} \quad 78$$

where $\Phi_{max}$ is the equivalent sand surface porosity of shale and C3 is a constant. These constants $\Phi_{max}$ and C3 are determined from boundary conditions. Eq. 78 is evaluated from a depth versus bulk density ($\sigma_b$) relationship for shales by the following relationship:

$$(\sigma_{sh}-\sigma_b)/(\sigma_{sh}-1) = \Phi_{she} e^{-(C3\ TVD)}$$

where $\sigma_{sh}$ is the shale bulk density and $\Phi_{she}$ is the equivalent maximum (sand) porosity of shales and is obtained by assuming that the bulk density behavior of shales is the same as the bulk density behavior of sands.

Figure 9:
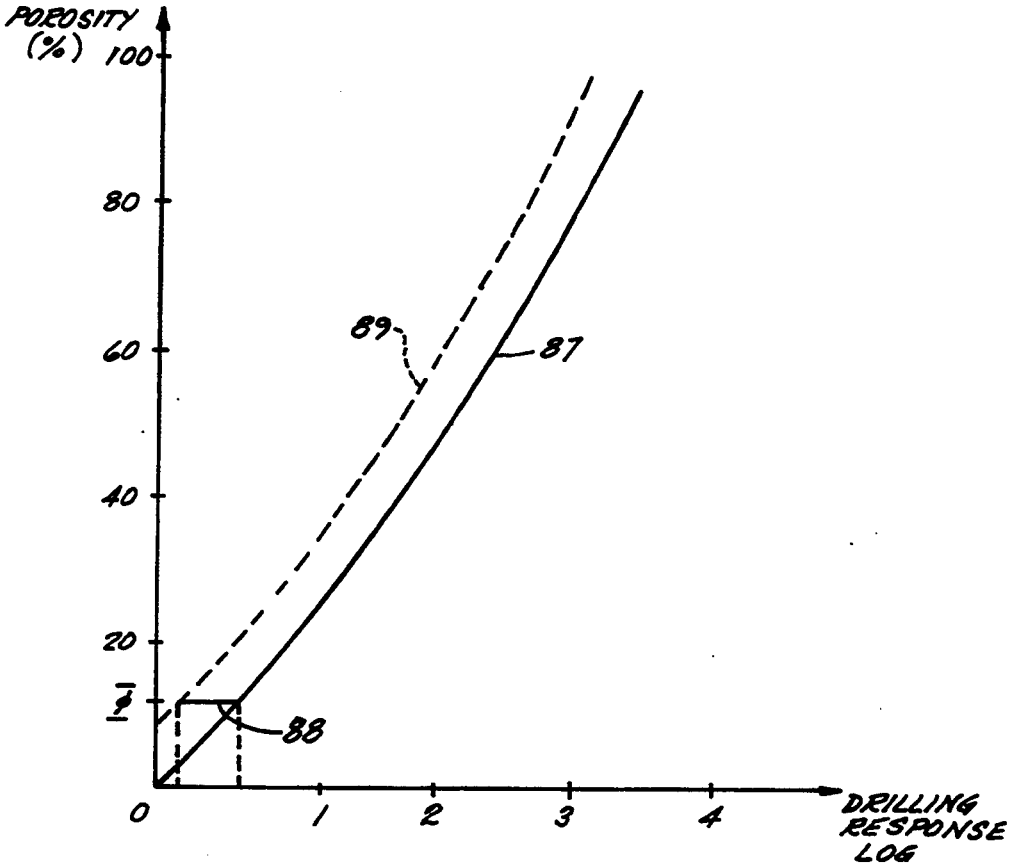
FIG. 9 is a plot of porosity versus the logrithmic value of a drilling response for a formation.

Referring to FIG. 9, a plot of the drilling response log versus porosity in accordance with Eq. 77 is shown. The three constants A1, A2 and A3 in Eq. 77 were determined by cross plotting known formation porosity with log (TOR ROP/($WOB_2$RPM)) for clean sand-shale sequences (with a new bit & balanced conditions). In general, log (TOR ROP/($WOB^2$ RPM)) is effected by pore pressure, bit wear, compaction and drilling problems. Overbalance conditions, bit wear and compaction will reduce the log's value and underbalance conditions will increase it. Corresponding to each depth the shale porosity can be obtained from Eq. 78. The corresponding expected log of the drilling response (log (TOR ROP/($WOB^2$ RPM)) can be computed from Eq. 77. By keeping track of shales and their corresponding log (TOR ROP/($WOB^2$ RPM)) values while drilling, an average value of log (TOR ROP/($WOB^2$ RPM)) can be computed for shale at each depth. If the average value of log (TOR ROP/($WOB^2$RPM)) for shale is different from the expected value at any depth from Eq. 78, then the difference between the two values gives the correction necessary to compensate for pore pressure, bit, bit wear and compaction effects. To correct for these effects, a curve 87 given by Eq. 77 is then shifted by the amount of the correction 88 generating a shifted curve 89. The formation drilling porosity corresponding to the actual (measured) value of log(TOR ROP/($WOB^2$ RPM)) at that depth is then obtained from the shifted curve.

Since the formation at any depth is a mixture of sands and shales in different proportions, the computed drilling porosity reflects the effect of both these constituents. The porosity contribution from sands only (drilling sandstone porosity) is then obtained by eliminating the effect of shale as follows:

$$\Phi_{sd} = \Phi_{comp} - \text{vsh}\ \Phi_{sh} \quad 79$$

where $\Phi_{sd}$ is the drilling sandstone porosity (effects of shale removed), $\Phi_{comp}$ is the computed drilling porosity (which includes shale effects), $\Phi_{sh}$ is the shale porosity from Eq. 78, and vsh is the percentage of shales in the formation (from gamma ray measurements).

Using the above procedure, drilling porosity or drilling sandstone porosity thus found is compensated for bit wear, bit, compaction and pore pressure effects. However, drilling porosity is not compensated for other drilling problems (e.g. bit balling, hanging stabilizers). Both the porosity signal and the porosity log can be compensated for formation effects (i.e., shale effects) by the above described relationships.

As discussed above, the three constants A1, A2 and A3 may be obtained by plotting known formation porosity with log (TOR ROP/($WOB^2$ RPM)) for clean sand-shale sequences (with a new bit & balanced conditions).

Figure 10:
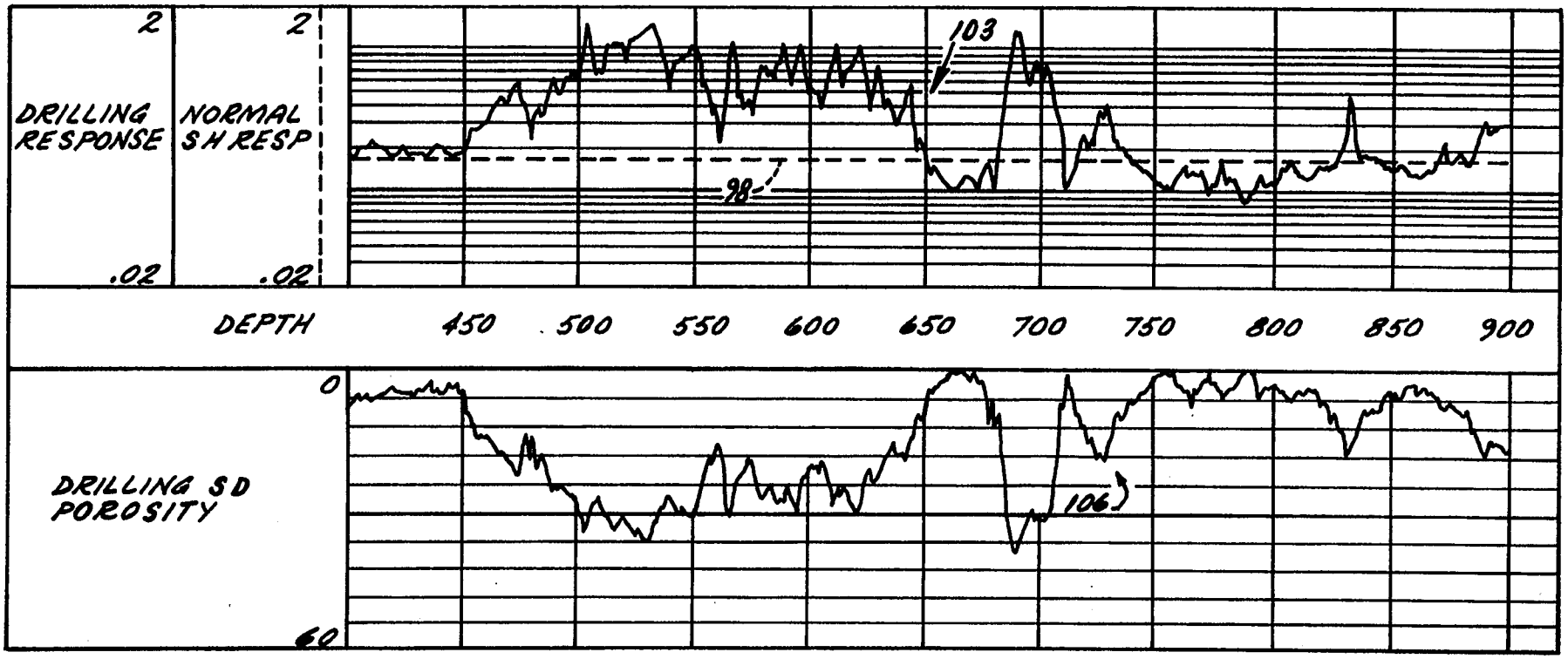
FIG. 10 is a porosity log compensated for formation effects in accordance with the present invention.

An important feature of this invention is the sand porosity with the effects of shale removed. Prior art porosity measurements (i.e., density log derived porosity assuming one matrix) included the effects of shale. It is desirable that the effects of shale be removed since generally hydrocarbon deposits are found in the sand and not in the shale. Therefore, the sand porosity with the shale effects removed provides a more precise indication of a typical commercial hydrocarbon formation than does the prior art density log derived porosity using a constant matrix. The porosity signal and the porosity log both of which are compensated for formation effects are defined by the above described relationship. Referring to FIG. 10, an example of a porosity log compensated for formation effects produced by plotter 30 in accordance with the present invention is shown generally at 106. Log 106 is shown in relation to drilling response log 103. This log 106 represents formation porosity compensated for formation effects, thus identifying lithology changes and detecting drilling problems.

It will be appreciated that: the insitu porosity is derived from mechanical measurements only (i.e., WOB, ROP, RPM, TOR and TVD). However, the sand porosity with the shale effects removed (porosity compensated for formation effects) requires gamma ray measurement to account for the percentage of shale in the formation (Eq. 79). Accordingly, two porosity signals and logs are provided.

DIFFERENTIAL PRESSURE

Differential pressure can be determined from the drilling response wherein continuous pore pressure is determined under the assumption of the one lithology (e.g., shale). The drilling response log for normal conditions (i.e., Pm=Pp) can be expressed as:

$$\log(TOR\ ROP/(WOB^2\ RPM))_N = \log((TOR/(WOB\ D))_0 - \log(C_1\ \sigma_0) + \log(\eta F(\eta)) \quad \text{Eq. 80}$$

where $C_1=\log(0.5\ tax\ (o))$, and $\sigma_0$=insitu rock strength.

Figure 11:
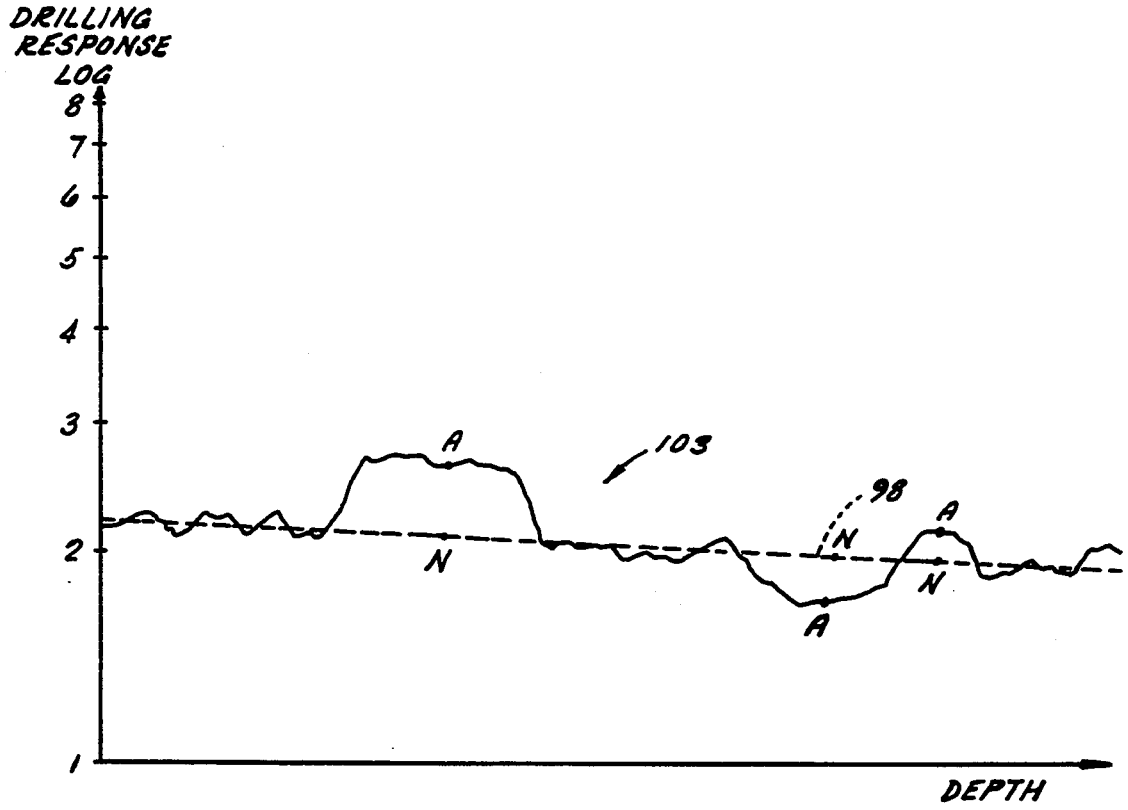
FIG. 11 is a drilling response log in accordance with the present invention.

Referring now to FIG. 11, log (TOR ROP/(WOB$^2$ RPM))$_N$ is the drilling response log 103 for shale under normal conditions (i.e., Pm=Pp) and line 98 is the shale base line. The shale base line (i.e., shale response curve) 98 is characterized by the geostatic load (i.e., overburden curve) for the region. Line 98 is superimposed on drilling response curve 103 at a shale location where $\delta P=0$ or is known. The drilling response for other than normal conditions (i.e., Pm≠Pp) can be expressed as:

$$\log(TOR\ ROP/(WOB^2\ RPM))_A = \log(TOR/(WOB\ D))_0 - \log(C_1\ \sigma_0) + \log(f(Pp,\ Pm)) + \log(\eta\ F(\eta)) \quad \text{Eq. 81}$$

where:

$$f(Pp,\ Pm)=1/(1+(\delta P\alpha));\ \text{and} \quad 82$$

log (TOR ROP/(WOB$^2$ RPM))$_A$ is the drilling response log for other than normal conditions (i.e., Pm≠Pp). From Eqs. 80 and 81 f(Pp, Pm) can also be expressed as:

$$f(Pp,\ Pm)=(TOR\ ROP/(WOB^2\ RPM))_A/(TOR\ ROP/(WOB^2\ RPM) \quad 83$$

Solving Eq. 82 for $\delta P$ results in:

$$\delta P=\alpha[(1/f(Pp,\ Pm))-1] \quad 84$$

where $\alpha$ is a function of bit and rock properties, $\alpha=1$ was found to provide good results in shales. $\delta P$ can also be expressed as:

$$\delta P=\alpha[((TOR\ ROP/(WOB^2\ RPM))_N/(TOR\ ROP/(WOB^2\ RPM))_A)-1] \quad 85$$

by substituting f(Pp, Pm) (Eq. 83) into Eq. 84.

For a continuous differential pressure the dependence on $\alpha$ in Eq. 85 is eliminated by transforming sand/shale sequences into one lithology (e.g., shale).

Figure 12:
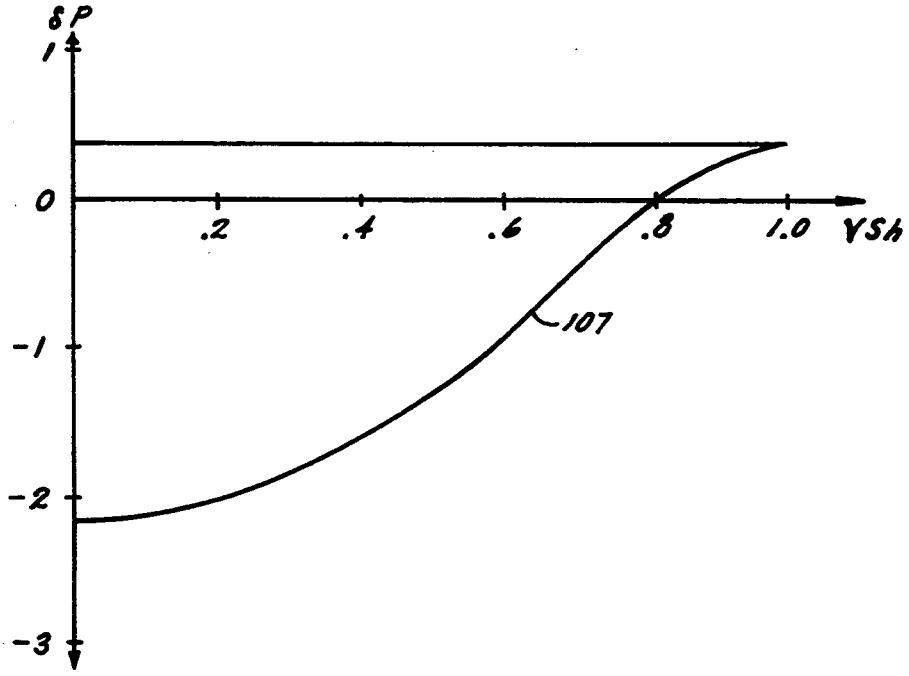
FIG. 12 is a plot of a transformed differential pressure curve versus volume of shale in a formation.

Referring to FIG. 12 differential pressure $\delta P$ is plotted as a function of shale volume (vsh) for clean sand shale sequences where gamma ray measurements are employed to determine vsh. The curve 107 ($\delta P_T$) is used to transform resulting data into 100% shale. The calculated differential pressure ($\delta P_c$) is expressed as:

$$\delta P_c=\alpha[((TOR\ ROP/(WOB^2\ RPM))_N/(TOR\ ROP/(WOB^2\ RPM)_A))-1] \quad 86$$

Accordingly the differential pressure ($\delta P$) is determined by:

$$\delta P=\delta P_c-\delta P_T \quad 87$$

Figure 13:
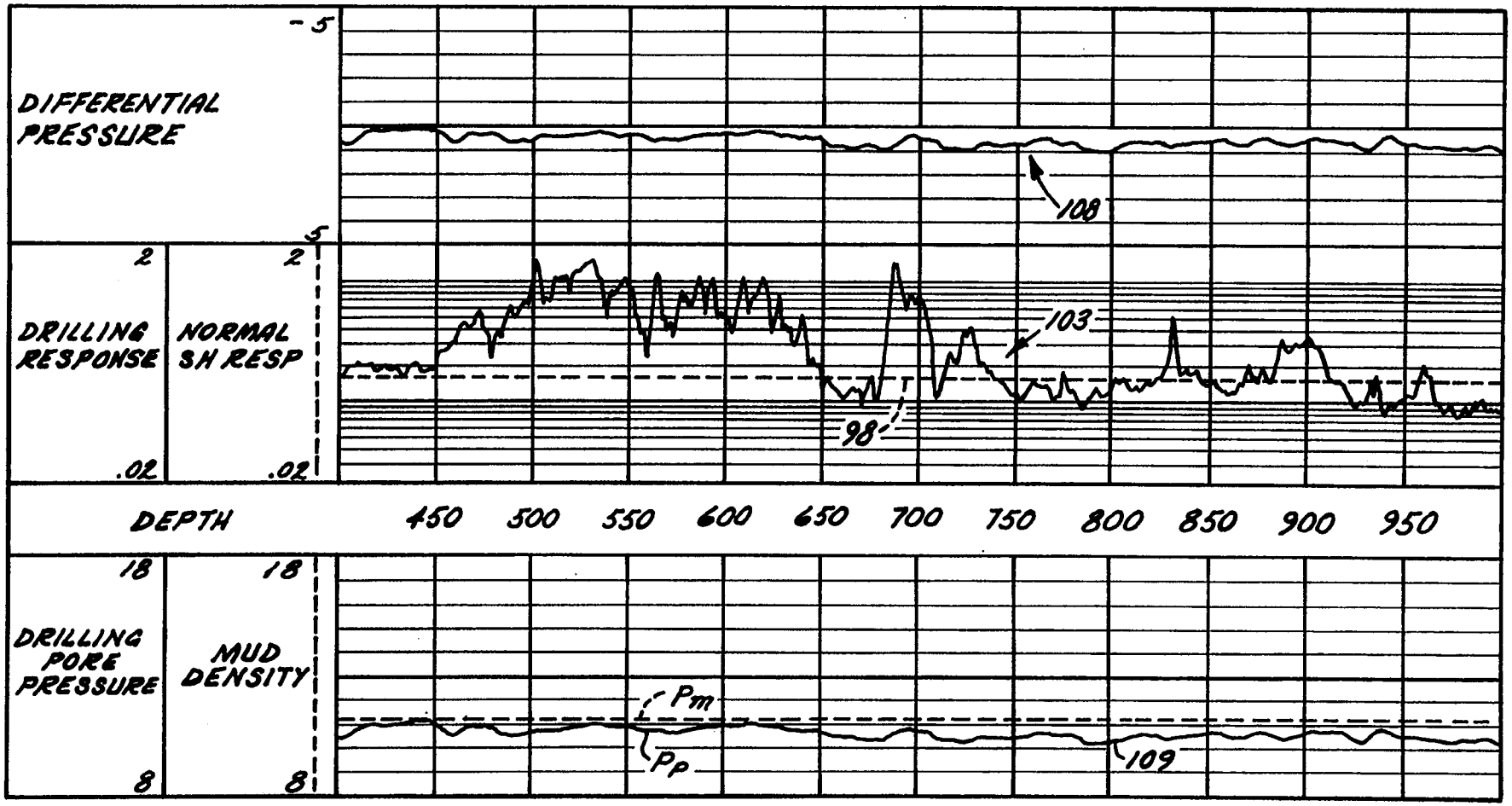
FIG. 13 is a differential pressure log in accordance with the present invention.

Differential pressure is thus compensated for formation and compaction effects by the above described procedure. Also, the differential pressure signal and the differential pressure log are defined by the above described relationships. Referring to FIG. 13, an example of a differential pressure log produced by plotter 30 in accordance with the present invention is shown generally at 108. Log 108 is shown in relation to drilling response Log 103. This log 108 represents differential pressure and is used to detect drilling problems. Moreover with a known mud pressure Pm the formation pore pressure Pp is determined by:

$$Pp=Pm-\delta P \quad 88$$

and is shown in FIG. 13 at 109.

It will be appreciated that the pore pressure signal can be derived from differential pressure (including differential pressure compensated for formation effects) by the relationship of Eq. 88.

Important features of the present invention are the differential pressure, and the formation pore pressure derived from WOB, TOR, ROP, RPM and gamma ray measurements, wherein the gamma ray measurements are used to compensate for formation effects. The formation pore pressure and the differential pressure can be employed to determine desired mud density to be used during drilling operations. It will be further appreciated that differential pressure (i.e., $\delta P$=Pm−Pp) is different from the overpressure porosity described in U.S. Pat. No. 4,883,914 to Rasmus (described hereinbefore). More particularly, the overpressure porosity is the supernormal pressure caused by overburdening (i.e., formation compaction stress increases when water is trapped in the porous formation).

DRILLING ALERTS

A drilling alert log which provides an early warning of drilling problems is presented. Drilling alerts are associated with a lower than normal drilling response. The drilling alert log can be expressed as either a severity ratio (TOR ROP/(WOB$^2$ RPM))$_N$ /(TOR ROP/(WOB$^2$ RPM))$_A$ or a sudden increase in derived differential pressure $\delta P$. A sudden increase in differential pressure implies a low formation pore pressure Pp, since mud pressure Pm is controlled by the operator.

A maximum differential pressure $\delta P_{max}$ associated with standard drilling operations is selected by the operator. This ($\delta P$ max) is required during drilling operations in order to maintain a mud pressure Pm in excess of the formation pore pressure Pp, thus avoiding a blow out or borehole collapse (described hereinbefore). Accordingly, any value above $\delta P_{max}$ is generally attributed to drilling problems. The maximum differential pressure $\delta P_{max}$ during normal drilling is expressed as:

$$\delta P_{max}=\alpha[(TOR\ ROP/(WOB^2\ RPM))_N/((TOR\ ROP/(WOB^2\ RPM))_{A1}-1] \quad 89$$

where (TOR ROP/(WOB$^2$ RPM))$_N$ is the drilling response when Pm=Pp (i.e., shale base line) and (TOR ROP/(WOB$^2$ RPM))$_{A1}$ is the drilling response when $\delta P=\delta P_{max}$. The differential pressure at a location contributed by drilling problems is expressed as:

$$\delta P_{prob}=\alpha[(TOR\ ROP/(WOB^2\ RPM))_N/((TOR\ ROP/(WOB^2\ RPM))_{A2}-1)] \quad 90$$

where $(TOR\ ROP/(WOB^2\ RPM))_{A2}$ is the drilling response at any location with drilling problems (i.e., abnormal operating conditions). A drilling alert (DPR) can be expressed as:

$$DPR=\delta P_{prob}-\delta P_{max} \quad 91$$

Substituting Eqs. 89 and 90 provides:

$$DPR = \alpha\ (TOR\ ROP/(WOB^2\ RPM))_N\ [(1/(TOR\ ROP/(WOB^2\ RPM))_{A2}) - (1/(TOR\ ROP/(WOB^2\ RPM))_{A1})] \quad \text{Eq. 92}$$

Drilling alerts can be represented on a log as a difference between the drilling problems and the actual drilling response curve, as follows:

$$DPRI = \log\ [\alpha\ (TOR\ ROP/(WOB^2\ RPM))_N\ ((1/(TOR\ ROP/(WOB^2\ RPM))_{A2}) - (1/(TOR\ ROP/(WOB^2\ RPM))_{A1}))] - \log\ (TOR\ ROP/(WOB^2\ RPM))_{A2}$$

The drilling alert signal and the drilling alert log are defined by the above described relationship.

Figure 14:
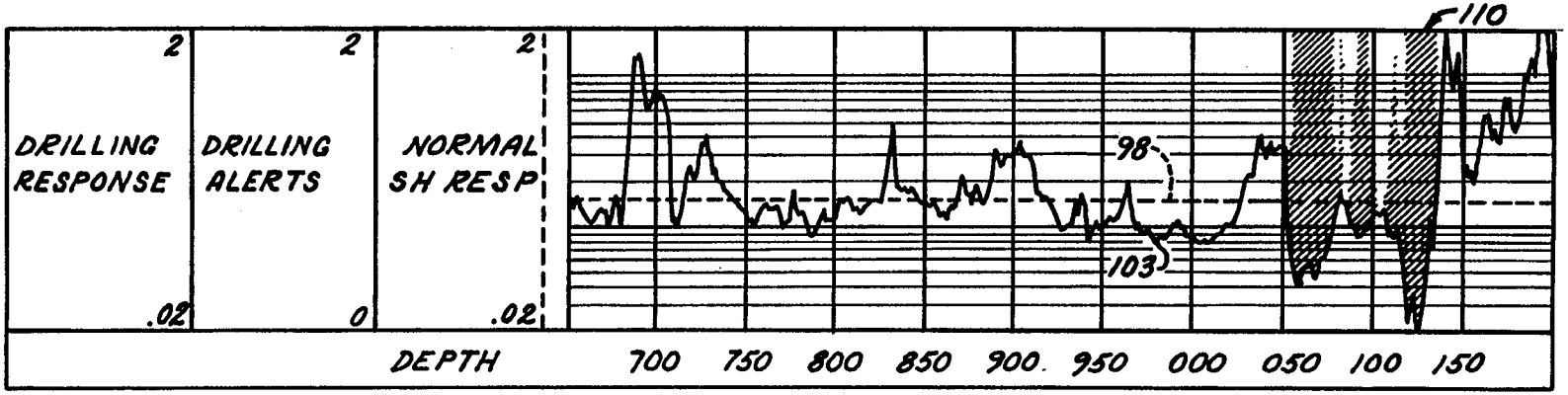
FIG. 14 is a drilling alert log in accordance with the present invention.

Alternatively, drilling alerts can be expressed as a severity ratio log $(TOR\ ROP/(WOB^2\ RPM))_A/(TOR\ ROP/(WOB^2\ RPM))_N$. It will be appreciated that the severity ratio log does not employ gamma ray measurements and, therefore, is in real time at the depth of the bit. Referring to FIG. 14, an example of a drilling alert log produced by plotter 30 in accordance with the present invention is shown generally at 110. Log 110 is shown in relation to drilling response Log 103. The drilling alert log 110 provides continuous monitoring while corrections are being applied. Further, the log provides an indication of the severity of the problem. While the drilling alert log does not identify the source of the drilling problem, it does alert the operator of a drilling problem.

BIT WEAR FACTOR

Bit wear factor is an indicator of the extent of tooth wear in a bit. It varies from 1 for a new bit to 0 for a completely worn bit. The bit wear factor n can be determined by solving Eq. 33 as follows:

$$\eta = (-(\mu_e/4)\ (ROP\ D/(WOB\ RPM))_{n1} + ((\mu_e/4)\ (ROP\ D/(WOB\ RPM))^2_{n1} + 4\ (TOR\ ROP/(WOB^2\ RPM))\ ((TOR\ ROP/(WOB^2\ RPM))_{n1} - (\mu_e/4)\ (ROP\ D/(WOB\ RPM))_{n1}))^{\frac{1}{2}})/(2\ ((TOR\ ROP/(WOB\ RPM))_{n1} - ((\mu_e/4)\ (ROP\ D/(WOB\ RPM))_{n1})) \quad \text{Eq. 93}$$

where $(ROP\ D/(WOB\ RPM))_{n1}$ is the rock drillability at the start of a bit run, $(TOR\ ROP/(WOB^2\ RPM))_{n1}$ is the drilling response at the start of a bit run, and $\mu_e$ is assumed from empirical data or obtained as the intercept from the normalized torque TOR/(WOB D) versus rock drillability ROP D/(WOB RPM) crossplot (FIG. 6). While drilling in a shale formation, the normalized torque and rock drillability on the shale base line at any depth can be taken as the values corresponding to a new bit condition and the measured value of the the drilling response will be used to represent the start of the bit run. Eq. 93 also expresses a bit wear factor log when plotted as a function of depth.

Figure 17:
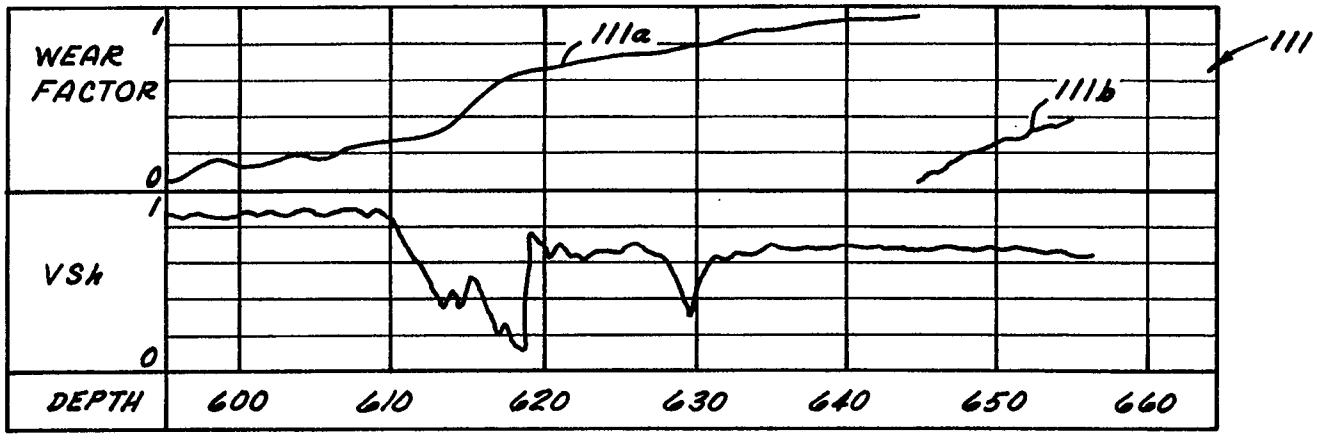
FIG. 17 is a bit wear factor log in accordance with the present invention.

The bit wear factor signal and the bit wear factor log are defined by the above described relationships. It should be noted that the bit wear factor $\eta$ may be affected by other drilling problems. Referring to FIG. 17, an example of a bit wear factor log produced by plotter 30 in accordance with the present invention is shown generally at 111. Log 111 detects bit wear and is used to indicate when the bit is to be replaced. This is indicated by a line 111*a* being prior to bit replcement and line 111*b* being after bit replacement. Log 111 is shown in relation to vsh.

BEARING WEAR

For single and multi-cone bits (i.e., impact bit) the amount of bearing wear can be determined from the mechanical measurements described herein. With a known WOB, bearing life/wear can be expressed in terms of total revolutions (provided no appreciable temperature increases occur). Thus, bearing wear is linearly related to bit revolutions. Bearing life is also dependent on the load applied. Each bearing has a finite service life which is specified by its load specifications. However, in a drilling process where drilling mud contains abrasive particles, mud properties (in case of non-sealed bearings) also affect the bearing life. As the bearing wears, the cones start wobbling thereby causing intermeshing of teeth on the cones. This causes tooth wear and breakage, thus associating bearing wear with tooth wear or breakage.

A bearing failure which is a result of some form of mechanical abuse, can be related to or expressed by an increase in torque-to-weight ratio as a result of increase in friction at the bearing surfaces. The resulting temperature increase can cause a seal or lubricant failure. The bearing may still roll on (continue to wear loose) with increased torque or it may lock up. If a bearing locks up, the cone can act as a partial drag bit; in this case increased torque is generated since normal torque is higher for drag bits than for impact bits. Accordingly, bit torque is an important factor in bearing related problems.

The following well known expression is used in estimating bearing wear:

$$dB/dt=K\ WOB^{\alpha 2} RPM \quad 94$$

where $K=\alpha$ constant depending on operating conditions and exponent $\alpha 2$ expresses effect of bit weight on bearing wear and is known to vary between 1.5 and 2, depending on the type of bearing and the mud properties. The cumulative bearing wear is expressed as:

$$B=\int dB=\int K\ WOB^2\ RPM\ dt \quad 95$$

where $\alpha 2=2$ is assumed and the constant K is assumed to be a function of the type of bearing and fluid properties.

$$B=\Sigma B_i=K\ L1\ [(WOB^2\ RPM/ROP)_1+(WOB^2\ RPM/ROP)_2+\ldots] \quad 96$$

This expression can be expressed in terms of torque by including the expression for drilling response as follows:

$$B=K\ L1\ [(TOR_e/D_r)_2+\ldots] \quad 97$$

where $D_r=TOR_a ROP/(WOB^2\ RPM)$ (i.e., drilling response), $TOR_a$ is the measured torque, L1 is the depth interval over which ROP and other drilling measurements are assumed constant, $TOR_e$ is the expected bit torque; and K is a constant depending on the bearing. A bearing wear log results when Eq. 97 is plotted as a function of depth.

The inclusion of torque in the model (Eq. 94) is an important feature of the present invention. This allows (a) prediction of and/or onset of a bearing failure into the model and (b) demonstrates the potential use of drilling response for bearing wear predictions. Eq. (97) can also be expressed as:

$$B=K\ L1\ [(WOB^2\ RPM/ROP)_1 TOR_{r1} \quad 98$$

where $TOR_r=(TOR_e/TOR_a)$.

Thus for no bearing failure or excessive tooth/cutter wear, $T_a=T_e$. Therefore, bearing wear is given by:

$$B=K\ L1\ [(WOB^2\ RPM/ROP)_1+(WOB^2\ RPM/ROP)_2+\ldots] \quad 99$$

Accordingly, bearing wear/failure is inversely proportional to drilling response. Therefore, as bearing wear increases, drilling response decreases. It will be appreciated that drilling response decreases as the teeth wear out. Thus, drilling response is effected by both bearing wear and tooth wear. Drilling response increase can be caused by higher than expected torque increase. This abnormal increase in torque caused by friction at the bearing surfaces could cause the bearings to fail (seal or lubricant failure due to temperature increase as a result of friction). The bearing could lock up causing the cone to act as a partial drag bit. Under normal conditions bearing wear should increase uniformly with depth.

Figure 15:
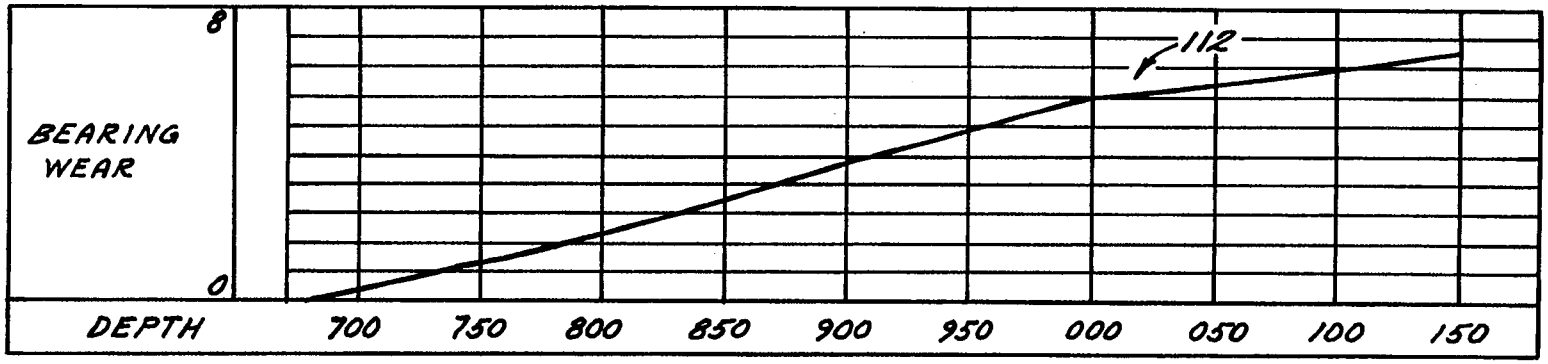
FIG. 15 is a bearing wear log in accordance with the present invention.

An increase in the rate of bearing wear may be associated with lower than normal ROP and TOR (low drilling response) implying a harder to drill formation and so is associated with higher than normal bit wear. A decrease in the rate of bearing wear may be associated with higher than normal TOR and/or ROP (higher drilling response) implying an easier to drill formation and so associated with lower than normal bit wear. The bearing wear signal and the bearing wear log are defined by the above described relationships. Referring to FIG. 15, an example of a bearing wear log produced by plotter 30 in accordance with the present invention is shown generally at 112.

TORQUE ANALYSIS

Depending on the bit, formation and WOB, a certain torque at the bit could be generated. However, more than expected (abnormal torque increase) or less than expected torque (abnormal torque loss) can result under certain conditions. Abnormal torque increase at the bit can be associated with the following: (1) locked/failed bearing, (2) undergage bit behind a NB stabilizer, or (3) a lithology change. Abnormal torque loss however, can also be associated with tooth/cutter wear. Therefore, abnormal torque (i.e., abnormal torque increase and abnormal torque loss) can be a useful indicator of some drilling problems.

The TOR/(WOB D) ratio for clean sand-shale sequences under normal pore pressure conditions as a function of vsh can be expressed as:

$$TOR/(WOB\ D)=a1\ vsh^n+a2vsh^{n-1}+\ldots \quad 100$$

where TOR/(WOB D) is set so that TOR/(WOB D)=0 for vsh=1.

While keeping track of shales while drilling an average value of TOR/(WOB D) is computed for each depth. At each depth, Eq. 100 is adjusted so that the (TOR/WOB D) value at vsh=1 equals the actual value of TOR/(WOB D) for shales at that depth.

Corresponding to actual vsh at each depth, the expected value of TOR/(WOB D) is determined from the shifted (adjusted) curve (Eq. 100). The expected torque is then computed using the measured value of WOB at that depth, thus expected torque ($TOR_e$) is expressed as:

$$TOR_e=WOB\ D\ (TOR/(WOB\ D)_e \quad 101$$

The expected torque $TOR_e$ at the bit is then compared to the analysis log (i.e., $TOR_a$–$TOR_e$). If the expected torque is actual (measured) torque TOR at the bit to generate a torque lower than the measured torque, the difference is then the abnormal torque increase generated at the bit due to bit problems. If the actual torque is lower than expected torque, the difference (or "torque loss") could be due to tooth wear/breakage. Lithology changes are compensated for in the model.

Figure 16:
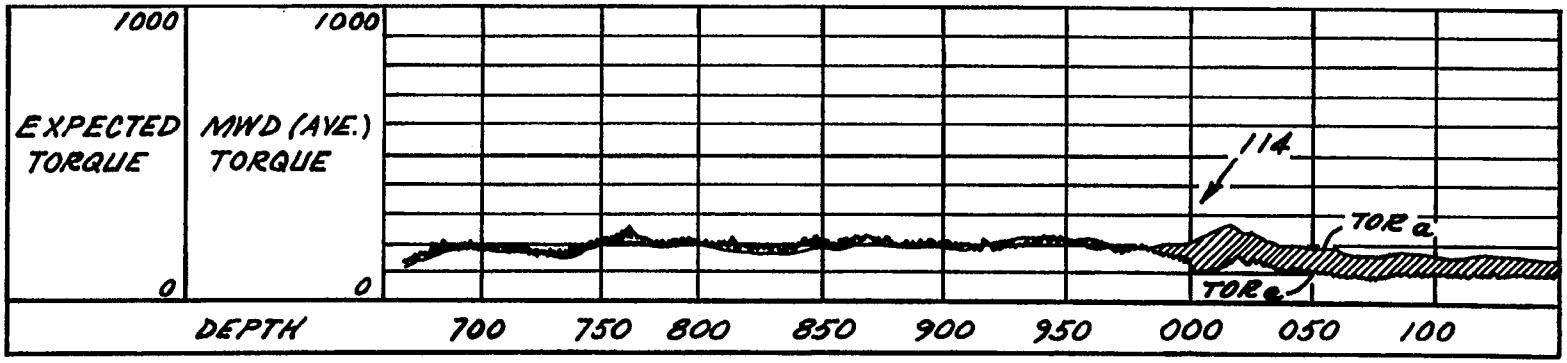
FIG. 16 is an torque analysis log in accordance with the present invention.

Accordingly, MWD measured torque is an important indicator of any drilling abnormalities near the bit. Moreover, by simultaneously analyzing abnormal increase or loss of torque, bearing wear and drilling response curves it is possible to recognize, isolate and distinguish between various bit related problems while drilling (e.g., bearing wear/failure, undergage bits and cutter, i.e., tooth wear) with rock bits. However, with drag bits, an abnormal increase or loss of torque indicates undergage stabilizers, formation squeeze, cutter wear or sloughing shales. The torque analysis signal and the torque analysis log are defined by the above described relationships. Referring to FIG. 16, an example of an a torque analysis log produced by plotter 30 in accordance with the present invention is shown generally at 114. This log 114 represents an abnormal increase or loss of torque and can be used to detect drilling problems.

While preferred embodiments have been shown and described various modifications and substitutions may be made thereto without departing from the spirit and scope of the invention. Accordingly, it is to be understood that the present invention has been described by way of illustrations and not limitations.

What is claimed is:

1. A method for investigating properties of subsurface formations traversed by a borehole, the method comprising the steps of:

generating while drilling a plurality of signals indicative of formation properties derivable from measurements made while drilling including downhole weight on bit (WOB), bit torque (TOR), bit revolutions (RPM) and rate of penetration (ROP);

in response to said plurality of signals, generating a drilling response signal, said drilling response signal being a function of a ratio of a term which includes bit torque (TOR) and rate of penetration (ROP) and a term which includes weight on bit (WOB) and bit revolutions (RPM); and in response to said drilling response signal, optimizing the drilling process.

2. The method of claim 1 further comprising the step of:

in response to said drilling response signal, generating drilling response log.

3. The method of claim 2 wherein said drilling response log comprises a plat of the following relationship:

$$\text{drilling response log} = \log(TOR\ ROP/(WOB^2\ RPM))$$

where,

TOR=bit torque,

ROP=rate of penetration,

WOB=weight on bit,

RPM=bit revolutions.

4. The method of claim 2 further comprising the step of:

generating a shale base line.

5. The method of claim 4 further including the step of:

superimposing said shale base line on said drilling response log with respect to a location of a known differential pressure.

6. The method of claim 1 further comprising the steps of:

in response to said drilling response signal, generating a porosity signal; and in response to said porosity signal, optimizing the drilling process.

7. The method of claim 6 further comprising the step of in response to said porosity signal, generating a porosity log.

8. The method of claim 7 wherein said porosity log comprises the following relationship:

$$\text{porosity log} = A1\ (\log(TOR\ ROP/(WOB_2\ RPM)))^2 + A2\ (\log(TOR\ ROP/(WOB^2\ RPM))) + A3$$

where,

TOR ROP/(WOB$^2$ RPM)=drilling response,

TOR=bit torque,

ROP=rate of penetration,

WOB=weight of bit,

RPM=bit revolutions,

A1, A2 and A3 are constants.

9. The method of claim 6 further including the step of:

compensating said porosity signal for formation effects.

10. The method of claim 9 further comprising the step:

in response to said porosity signal, generating a porosity log.

11. The method of claim 10 wherein said porosity log comprises the following relationship:

$$\text{porosity log} = A1\ (\log(TOR\ ROP/(WOB^2\ RPM)))^2 + A2\ (\log(TOR\ ROP/(WOB^2\ RPM))) + A3$$

where,

TOR ROP/(WOB$^2$ RPM)=drilling response,

TOR=bit torque,

ROP=rate of penetration,

WOB=weight of bit,

RPM =bit revolutions,

A1, A2 and A3 are constants.

12. The method of claim 9 wherein at least one of said derivable formation properties comprise a property representative of natural radioactivity of the formation.

13. The method of claim 12 wherein said property representative of natural radioactivity comprises:

measuring a plurality of emitted gamma rays to provide a signal indicative of the shale volume in the formation.

14. The method of claim 13 wherein said compensating said porosity signal comprises:

reducing said porosity signal by a product of said shale volume signal and a shale porosity signal.

15. The method of claim 14 wherein said shale porosity signal comprises the following relationship:

$$\text{shale porosity} = \Phi_{max} e^{-(C3\ TVD)}$$

where, $\Phi_{max}$ is the equivalent surface porosity of shale,

C3 is a constant,

TVD=true vertical depth.

16. The method of claim 1 further comprising the steps of:

in response to said drilling response signal, generating a differential pressure signal; and in response to said differential pressure signal, optimizing the drilling process.

17. The method of claim 16 further comprising the step of:

in response to said differential pressure signal, generating a differential pressure log.

18. The method of claim 17 wherein said differential pressure log comprises the following relationship:

$$\text{differential pressure log} = \alpha((TOR\ ROP/(WOB^2\ RPM))_N/(TOR\ ROP/(WOB^2\ RPM))_A) - 1)$$

where, (TOR ROP/(WOB$^2$ RPM))$_N$=drilling response under normal pore pressure conditions, (TOR ROP/(WOB$^2$ RPM))$_A$=drilling response under other than normal conditions, TOR=bit torque, ROP=rate of penetration, WOB=weight on bit, RPM=bit revolutions, $\alpha$ is a function of bit geometry and rock properties.

19. The method of claim 16 further including the step of:

determining formation pore pressure from said differential pressure signal.

20. The method of claim 16 further including the steps of:

determining desired drilling mud density from said differential pressure signal; and adjusting drilling mud density to said desired drilling mud density.

21. The method of claim 16 further including the step of:

compensating said differential pressure signal for formation effects.

22. The method of claim 21 wherein at least one of said derivable formation properties comprise a property representative of natural radioactivity of the formation.

23. The method of claim 22 wherein said property representative of natural radioactivity comprises:

measuring a plurality of emitted gamma rays to provide a signal indicative of the shale volume in the formation.

24. The method of claim 23 further including the step of:

deriving a transformed differential pressure signal to correspond to said shale volume signal.

25. The method of claim 24 wherein said compensating said differential pressure signal comprises:

reducing said differential pressure signal by said transformed differential pressure signal.

26. The method of claim 1 further comprising the steps of:

in response to said drilling response signal, generating a drilling alert signal; and in response to said drilling alert signal, optimizing the drilling process.

27. The method of claim 26 further comprising the step of:

in response to said drilling alert signal, generating a drilling alert log.

28. The method of claim 27 wherein said drilling alert log comprises a plat of the following relationship:

$$\text{drilling alert log} = \log((TOR\ ROP/WOB^2\ RPM))_N\ \alpha\ (1/(TOR\ ROP/WOB^2\ RPM))_{A2}) - (1/(TOR\ ROP/WOB^2\ RPM))_{A1})) - (\log(TOR\ ROP/WOB^2\ RPM))_{A2})$$

where, $(TOR\ ROP/(WOB^2\ RPM))_N$=drilling response for pore pressure equivalent to mud pressure, $(TOR\ ROP/(WOB^2\ RPM))_{A1}$=drilling response for a selected maximum differential pressure, $(TOR\ ROP/(WOB^2\ RPM))_{A2}$=drilling response for a drilling problem, TOR=bit torque, ROP=rate of penetration, WOB=weight on bit, RPM=bit rotations, $\alpha$ is a function of bit geometry and rock properties.

29. The method of claim 27 wherein said drilling alert log comprises a severity ratio, said severity ratio comprising a plat of the following relationship:

$$\text{severity ratio} = (TOR\ ROP/(WOB^2\ RPM))_A/(TOR\ ROP/(WOB^2\ RPM))_N$$

where, $(TOR\ ROP/(WOB^2\ RPM))_A$=drilling response under other than normal conditions, $(TOR\ ROP/(WOB^2\ RPM))_N$=drilling response under normal pore pressure conditions, TOR=bit torque, ROP=rate of penetration, WOB=weight on bit, RPM=bit rotations.

30. The method of claim 1 further comprising the steps of:

in response to said drilling response signal, generating a bit wear factor signal; and in response to said bit wear factor signal, optimizing the drilling process.

31. The method of claim 30 further comprising the step of:

in response to said bit wear factor signal, replacing the bit.

32. The method of claim 30 further comprising the step of:

in response to said bit wear factor signal, generating a bit wear factor log.

33. The method of claim 32 wherein said bit wear factor log comprises the following relationship when plotted as a function of depth:

$$\text{bit wear factor log} = (-(\mu_e/4)\ (ROP\ D/(WOB\ RPM))_{n1} + ((\mu_e/4)\ (ROP\ D/(WOB\ RPM))^2_{n1} + 4\ (TOR\ ROP/(WOB^2\ RPM))\ ((TOR\ ROP/(WOB^2\ RPM))_{n1} - (\mu_e/4)\ (ROP\ D/(WOB\ RPM))_{n1}))^{\frac{1}{2}})/(2\ ((TOR\ ROP/(WOB\ RPM))_{n1} - ((\mu_e/4)\ (ROP\ D/(WOB\ RPM))_{n1}))$$

where, $(ROP\ D/(WOB\ RPM))_{n1}$=rock drillability at the start of a bit run, $(TOR\ ROP/(WOB^2\ RPM))_{n1}$=drilling response at the star of a bit run, $\mu_e$=effective coefficient of friction between the bit and the formation, TOR=bit torque, ROP=rate of penetration, WOB=weight on bit, RPM=bit rotations.

34. The method of claim 1 further comprising the steps of:

in response to said drilling response signal, generating a bearing wear signal; and in response to said bearing wear signal optimizing the drilling process.

35. The method of claim 34 further comprising the step of:

in response to said bearing wear signal, replacing the bit.

36. The method of claim 34 further comprising the step of:

in response to said bearing wear signal, generating a bearing wear log.

37. The method of claim 36 wherein said bearing wear log comprises the following relationship when plotted as a function of depth:

$$\text{bearing wear log} = K\ L1\ ((TOR_e/(TOR_a\ ROP/(WOB^2\ RPM)))_1 + (TOR_e/(TOR_a\ ROP/(WOB^2\ RPM)))_2 + \ldots$$

where, $TOR_e$=bit torque expected, $TOR_a ROP/(WOB^2\ RPM)$=drilling response,

L1=depth interval,

K=a constant depending on bearing wear, $TOR_a$=measured bit torque,

ROP=rate of penetration,

WOB=weight on bit,

RPM=bit revolutions.

38. A method for investigating properties of subsurface formations traversed by a borehole, the method comprising the steps of:

generating while drilling a plurality of signals indicative of formation properties derivable from measurements made while drilling including downhole weight on bit (WOB), bit torque (TOR), bit revolutions (RPM) and rate of penetration (ROP);

in response to said plurality of signals, generating a drilling alert signal;

in response to said drilling alert signal, generating a drilling alert log, wherein said drilling alert log comprises the following relationship:

$$\text{drilling alert log} = \log((TOR\ ROP/WOB^2\ RPM))_N\ \alpha\ (1/(TOR\ ROP/WOB^2\ RPM))_{A2}) - (1/(TOR\ ROP/WOB^2\ RPM))_{A1})) - (\log(TOR\ ROP/WOB^2\ RPM))_{A2})$$

where, $(TOR\ ROP/(WOB^2\ RPM)_N$=drilling response for pore pressure equivalent to mud pressure, $(TOR\ ROP/(WOB^2\ RPM))_{A1}$=drilling response for a selected maximum differential pressure, $(TOR\ ROP/(WOB^2\ RPM)_{A2}$=drilling response for a drilling problem, $\alpha$ is a function of bit geometry and rock properties;

in response to said drilling alert log, optimizing the drilling processor.

39. A method for investigating properties of subsurface formations traversed by a borehole, the method Comprising the steps of:

generating while drilling a plurality of signals indicative of formation properties derivable from measurements made while drilling including downhole weight on bit (WOB), bit torque (TOR), bit revolutions (RPM) and rate of penetration (ROP);

in response to said plurality of signals, generating a drilling alert signal;

in response to said drilling alert signal, generating a drilling alert log;

wherein said drilling alert log comprises a severity ratio, said severity ratio comprising the following relationship:

$$\text{severity ratio} = (TOR\ ROP/(WOB^2\ RPM))_A/(TOR\ ROP/(WOB^2\ RPM))_N$$

where, $(TOR\ ROP/(WOB^2\ RPM))_A$=drilling response under other than normal conditions, $(TOR\ ROP/(WOB^2\ RPM))_N$=drilling response under normal pore pressure conditions in response to said drilling alert log, optimizing the drilling process.

40. A method for investigating properties of subsurface formations traversed by a borehole, the method comprising the steps of:

generating while drilling a plurality of first signals indicative of first formation properties derivable from measurements made while drilling, said first formation properties comprising properties representative of the mechanical process of drilling the borehole;

generating while drilling a second signal indicative of a second formation property derivable from measurements made while drilling, said second formation property representative of the lithology of the formation;

in response to said first and second signals, generating a differential pressure signal;

in response to said first signals and said differential pressure signal, generating a drilling alert signal; and in response to said drilling alert signal, optimizing the drilling process.

41. The method of claim 40 further comprising the step of:

in response to said drilling alert signal, generating a drilling alert log.

42. The method of claim 40 wherein said first formation properties representative of the mechanical process of drilling the borehole include weight on bit (WOB), bit torque (TOR), bit revolutions (RPM) and rate of penetration (ROP).

43. The method of claim 40 wherein said second formation property representative of the lithology of the formation comprises a property representative of natural radioactivity of the formation.

* * * * *